US012800230B2

(12) United States Patent
Xiao et al.

(10) Patent No.: US 12,800,230 B2
(45) Date of Patent: Nov. 17, 2026

(54) HEAT EXCHANGER AND MULTI-SYSTEM AIR CONDITIONING UNIT

(71) Applicant: SANHUA (HANGZHOU) MICRO CHANNEL HEAT EXCHANGER CO., LTD., Hangzhou (CN)

(72) Inventors: Ruixue Xiao, Hangzhou (CN); Jianlong Jiang, Hangzhou (CN); Zheng Wei, Hangzhou (CN); Junfeng Jin, Hangzhou (CN); Qiang Gao, Hangzhou (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 183 days.

(21) Appl. No.: 18/688,092

(22) PCT Filed: Sep. 2, 2022

(86) PCT No.: PCT/CN2022/116881
§ 371 (c)(1),
(2) Date: Feb. 29, 2024

(87) PCT Pub. No.: WO2023/030508
PCT Pub. Date: Mar. 9, 2023

(65) Prior Publication Data

US 2024/0393054 A1 Nov. 28, 2024

(30) Foreign Application Priority Data

Sep. 3, 2021 (CN) ..... 202122121246.2
Sep. 18, 2021 (CN) ..... 202122293928.1

(51) Int. Cl.
*F28D 1/04* (2006.01)
*F28D 21/00* (2006.01)

(52) U.S. Cl.
CPC .... *F28D 1/0426* (2013.01); *F28D 2021/0068* (2013.01)

(58) Field of Classification Search
CPC .... F28D 1/0426; F28D 1/053; F28D 1/05366; F28D 1/05383; F28D 1/05391;
(Continued)

(56) References Cited

U.S. PATENT DOCUMENTS 11,549,762 B2 * 1/2023 Pelletier ..... F28F 9/026
2008/0264621 A1 * 10/2008 Yoshino ..... F16L 21/035 165/178

(Continued)

FOREIGN PATENT DOCUMENTS

CN 1380203 A 11/2002
CN 101432590 A 5/2009

(Continued)

OTHER PUBLICATIONS

Pdf is translation of foreign reference CN-111316050-A (Year: 2020).*

(Continued)

*Primary Examiner* — Paul Alvare
*Assistant Examiner* — Kamran Tavakoldavani
(74) *Attorney, Agent, or Firm* — Bridgeway IP Law Group, PLLC; Jihun Kim

(57) ABSTRACT

A heat exchanger, includes: a first assembly including a first tube and a third tube; a second assembly including a second tube and a fourth tube; a plurality of heat exchange tubes, the heat exchange tube including a first heat exchange tube communicating the first tube with the third tube and a second heat exchange tube communicating the second tube with the fourth tube; and a fin, wherein part of the fin is connected with one first heat exchange tube, and the other part of the fin is connected with one second heat exchange tube. A first (Continued)

hydraulic diameter of the first tube is D1, a second hydraulic diameter of the second tube is D2, and 1<D1/D2≤6; and/or, a width of the first heat exchange tube is Tw1, a width of the second heat exchange tube is Tw2, and 1<Tw1/Tw2≤5.

20 Claims, 20 Drawing Sheets

(58) Field of Classification Search
CPC ..... F28D 2021/0068; F28F 1/022; F28F 2260/02; F24F 13/30
See application file for complete search history.

(56) References Cited

U.S. PATENT DOCUMENTS

2013/0213624 A1* 8/2013 Fujii ..... F28F 1/126 165/172
2015/0241129 A1* 8/2015 Cui ..... F28F 9/028 165/151
2019/0368817 A1* 12/2019 Huang ..... F28D 1/0426
2020/0191490 A1* 6/2020 Jin ..... F28D 1/0471
2021/0215431 A1* 7/2021 Joardar ..... F24F 1/14

FOREIGN PATENT DOCUMENTS

CN 103644685 A 3/2014
CN 110168294 A 8/2019
CN 210128652 U * 3/2020
CN 111316050 A * 6/2020 ..... F24V 50/00
CN 113108455 A 7/2021
JP 08219662 A 8/1996
JP 2018096568 A 6/2018

OTHER PUBLICATIONS

Pdf is translation of foreign reference CN-210128652-U (Year: 2020).*

* cited by examiner

HEAT EXCHANGER AND MULTI-SYSTEM AIR CONDITIONING UNIT

CROSS-REFERENCE TO RELATED APPLICATIONS

The present disclosure is a national phase entry under 35 USC § 371 of International Application No. PCT/CN2022/116881, filed on Sep. 2, 2022, which claims the priority and benefit of Chinese patent application No. 202122121246.2 filed on Sep. 3, 2021 and Chinese patent application No. 202122293928.1 filed on Sep. 18, 2021, the entire contents of which are hereby incorporated into the present disclosure by reference.

FIELD

The present disclosure relates to a field of air conditioning and refrigeration technologies, in particular to a heat exchanger and a multi-system air conditioning unit.

BACKGROUND

In the related art, a multiple-refrigeration-system air conditioning unit includes a plurality of refrigeration systems that can be operated independently to meet different operation requirements. Several systems may share one or more heat exchangers, and the several systems are isolated from each other and can operate independently. Taking a double-system heat exchanger as an example, the used multi-channel heat exchanger is shared by two systems, and the heat exchange units used in the two systems are often designed with the same heat exchange capacity, so it is difficult to match various operation conditions according to environmental requirements.

SUMMARY

A first aspect of the present disclosure provides a heat exchanger, which includes: a first assembly, including a first tube and a third tube; a second assembly, including a second tube and a fourth tube; a plurality of heat exchange tubes, wherein the heat exchange tube is a microchannel flat tube, and includes a plurality of channels arranged along a length direction of the heat exchange tube, the plurality of channels are arranged at intervals in a width direction of the heat exchange tube, and the heat exchange tube includes a first heat exchange tube and a second heat exchange tube, wherein the first heat exchange tube communicates the first tube with the third tube, the second heat exchange tube communicates the second tube with the fourth tube, the first heat exchange tube and the second heat exchange tube are arranged at intervals along a length direction of the first tube, the first tube and the second tube are not communicated with each other, and the third tube and the fourth tube are not communicated with each other; and a fin, wherein part of the fin is connected with one first heat exchange tube, the other part of the fin is connected with one second heat exchange tube, the first heat exchange tube, the fin and the second heat exchange tube are arranged along the length direction of the first tube, and a plurality of fins are arranged. A first hydraulic diameter of the first tube is D1, a second hydraulic diameter of the second tube is D2, a ratio of the first hydraulic diameter D1 to the second hydraulic diameter D2 is greater than 1 and less than or equal to 6; and/or, a width of the first heat exchange tube is Tw1, a width of the second heat exchange tube is Tw2, and a ratio of the width Tw1 of the first heat exchange tube to the width Tw2 of the second heat exchange tube is greater than 1 and less than or equal to 5.

A second aspect of the present disclosure also provides a heat exchanger, which includes: a first tube, a second tube, a third tube and a fourth tube; a heat exchange tube, wherein the heat exchange tube is a microchannel flat tube and includes a first heat exchange tube and a second heat exchange tube, and the first heat exchange tube is not communicated with the second heat exchange tube, wherein a plurality of first heat exchange tubes are arranged, and at least part of the first heat exchange tubes communicate the first tube with the third tube; a plurality of second heat exchange tubes are arranged, and at least part of the second heat exchange tubes communicate the second tube with the fourth tube; the first tube includes a first channel, the second tube includes a second channel, the first channel is communicated with the first heat exchange tube, the second channel is communicated with the second heat exchange tube, and a maximum length of the first channel in a length direction of the first tube is not equal to a maximum length of the second channel in a length direction of the second tube; and the first heat exchange tube and the second heat exchange tube are arranged at intervals along the length direction of the first tube, and the first heat exchange tube is arranged at a side of each of at least two second heat exchange tubes in the length direction of the first tube; and fins, wherein at least part of the fins are arranged between two adjacent heat exchange tubes in the length direction of the first tube.

A third aspect of the present disclosure also provides a multi-system air conditioning unit, which includes the heat exchanger provided in the second aspect of the present disclosure. The multi-system air conditioning unit includes a plurality of refrigeration systems, and at least two of the plurality of refrigeration systems share the heat exchanger.

It should be understood that both the above general description and the following detailed description are illustrative only and are not restrictive of the present disclosure.

DETAILED DESCRIPTION

Figure 1:
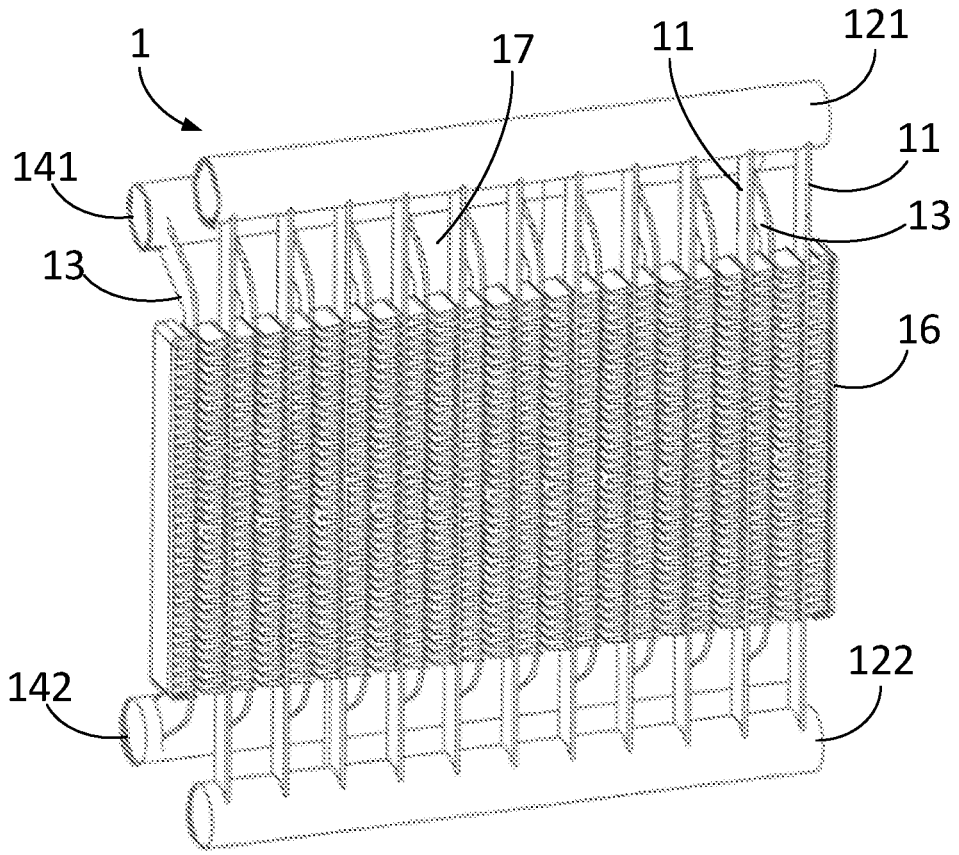
FIG. 1 is a schematic view of a heat exchanger according to an embodiment of the present disclosure.
Figure 2:
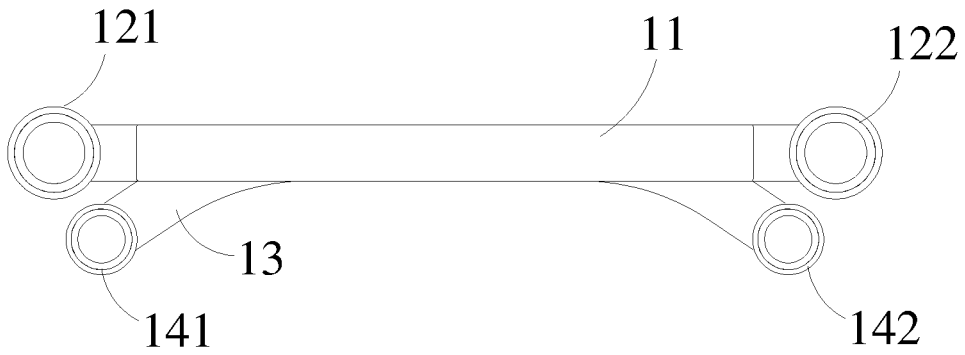
FIG. 2 is a top view of the heat exchanger shown in FIG. 1.

In order to make the purpose, technical scheme and advantages of the present disclosure more clear, the present disclosure will be further described in detail with reference to the attached drawings and examples. It should be understood that the specific embodiments described herein are only used to explain the present disclosure, and are not used to limit the present disclosure.

In the description of the present disclosure, unless otherwise specified and limited, terms such as "first" and "second" are only for purpose of description and cannot be understood as indicating or implying relative importance. Unless otherwise specified or explained, the term "a plurality of" refers to two or more than two. Terms such as "connect", "fix" shall be understood broadly, and the term "connect" may be, for example, a fixed connection, a detachable connection, an integral connection or an electrical connection, or may also be a direct connection or an indirect connection via intervening media. For those skilled in the art, the specific meaning of the above terms in the present disclosure can be understood according to the specific situations.

In the description of the specification, it should be understood that the directional words such as "up" and "down" recited in the embodiments of the present disclosure are described with regard to the angle shown in the attached drawings, and should not be understood as limiting the embodiments of the present disclosure. In addition, in the context, it should be understood that when an element is mentioned as being connected "on" or "under" another element, it can not only be directly connected "on" or "under" another element, but also indirectly connected "on" or "under" another element through an intermediate element.

As shown in FIGS. 1 to 12, the embodiments of the present disclosure provide a heat exchanger 1 and a multi-system air conditioning unit, and the heat exchanger 1 is used in the multi-system air conditioning unit. The heat exchanger 1 can be used as a condenser or an evaporator, and in the embodiments, the heat exchanger 1 is preferably used as an evaporator.

The multi-system air conditioning unit includes a compressor, a condenser, an expansion valve, the heat exchanger 1 serving as the evaporator, and a fan system. During the operation of multi-system air conditioning unit, a low-pressure vapor of a refrigerant is sucked in by the compressor and compressed into a high-temperature and high-pressure vapor, which is then discharged to the condenser. At the same time, an outdoor air sucked in by the fan system flows through the condenser, taking away the heat released by the refrigerant, so that the high-pressure refrigerant vapor condenses into a medium-temperature and high-pressure liquid. The medium-temperature and high-pressure liquid is converted into a low-temperature and low-pressure gas-liquid mixed state via the expansion valve, sprayed into the heat exchanger 1, and evaporated at a corresponding low pressure to absorb the surrounding heat. At the same time, the fan system makes the air continuously enter the heat exchanger 1 for heat exchange, and sends the cooled air after heat release to the indoor. In this way, the indoor air continuously circulates and flows to achieve the purpose of refrigeration and cooling. The refrigerant flowing out of the heat exchanger 1 becomes a low-temperature and low-pressure gas because it takes away the heat in the air (i.e. absorbing the heat), and is sucked back into the compressor again, to repeat such cycle.

In some embodiments, the heat exchanger 1 includes a first assembly, a second assembly, a plurality of heat exchange tubes and a fin. The first assembly includes a first tube 121 and a third tube 122, and the second assembly includes a second tube 141 and a fourth tube 142. The heat exchange tube is a microchannel flat tube, and the heat exchange tube includes a plurality of channels arranged along its length direction, and the plurality of channels are arranged at intervals in a width direction of the heat exchange tube. The heat exchange tube includes a first heat exchange tube 11 and a second heat exchange tube 13, the first heat exchange tube 11 communicates the first tube 121 with the third tube 122, the second heat exchange tube 13 communicates the second tube 141 with the fourth tube 142, and the first heat exchange tube 11 and the second heat exchange tube 13 are arranged at intervals along a length direction of the first tube 121. The first tube 121 and the second tube 141 are not communicated with each other, and the third tube 122 and the fourth tube 142 are not communicated with each other. Part of the fin 16 is connected with one first heat exchange tube 11, and the other part of the fin 16 is connected with one second heat exchange tube 13. The first heat exchange tube 11, the fin 16 and the second heat exchange tube 13 are arranged along the length direction of the first tube 121, and a plurality of fins 16 are provided. Therefore, the first heat exchange tube 11 and the second heat exchange tube 13 can share the fins 16, and when the unit is partially loaded, either the first heat exchange tube 11 or the second heat exchange tube 13 can exchange heat through all the fins 16, so that the heat exchange efficiency can be improved.

In some embodiments, a first hydraulic diameter of the first tube 121 is D1, a second hydraulic diameter of the second tube 141 is D2, and a ratio of the first hydraulic diameter D1 to the second hydraulic diameter D2 is greater than 1 and less than or equal to 6, so that the amount of the refrigerant that can flow through the second tube 141 is increased relative to the amount of the refrigerant that can flow through the first tube 121, which is beneficial to the heat exchange of the refrigerant and improves the heat exchange performance of a refrigeration system including the second tube 141. By adjusting the ratio of the first hydraulic diameter D1 to the second hydraulic diameter D2, two refrigeration systems can have different heat exchange performances to meet the requirements of different-load operation conditions of the air conditioning unit.

In some embodiments, the hydraulic diameters of the first tube 121 and the third tube 122 are the same, and the hydraulic diameters of the second tube 141 and the fourth tube 142 are the same. The first tube 121, the third tube 122 and the first heat exchange tube 11 can form a refrigeration loop, and the second tube 141, the fourth tube 142 and the second heat exchange tube 13 can form another refrigeration loop. The heat dissipation performances of the two refrigeration loops can be the same or different. In some embodiments, the heat dissipation performances of the two refrigeration loops are different. Specifically, two refrigeration loops with different heat dissipation performances can be obtained by adjusting the ratio of the first hydraulic diameter D1 to the second hydraulic diameter D2.

In some embodiments, the width of the first heat exchange tube 11 is Tw1, the width of the second heat exchange tube 13 is Tw2, and a ratio of the width Tw1 of the first heat exchange tube 11 to the width Tw2 of the second heat exchange tube 13 is greater than 1 and less than or equal to 5. In some embodiments, the hydraulic diameters of the first tube 121, the third tube 122, the second tube 141 and the fourth tube 142 are all the same, and the widths of the first heat exchange tube 11 and the second heat exchange tube 13 are different. The heat exchange capacity of the heat exchange tube with a large width is relatively strong. By making the widths of the first heat exchange tube 11 and the second heat exchange tube 13 different, the heat dissipation performances of the refrigeration loop including the first heat exchange tube 11 and the refrigeration loop including the second heat exchange tube 13 can be different. Specifically, by adjusting the ratio of the width of the first heat exchange tube 11 to the width of the second heat exchange tube 13 within the ratio range of 1-5, the different heat exchange performances of the two refrigeration loops can be obtained, so as to meet the requirements of different-load operation conditions of the air conditioning unit.

In some embodiments, the hydraulic diameters of the first tube 121 and the second tube 141 are different, and the widths of the first heat exchange tube 11 and the second heat exchange tube 13 are also different. Specifically, the ratio of the first hydraulic diameter D1 to the second hydraulic diameter D2 is in the range of 1-6, and the ratio of the widths of the first heat exchange tube 11 and the second heat exchange tube 13 is in the range of 1-5. Therefore, by adjusting the hydraulic diameters of the first tube 121 and the second tube 141 and the widths of the first heat exchange tube 11 and the second heat exchange tube 13 at the same time, two refrigeration loops of the heat exchanger can obtain different heat exchange capacities flexibly, so as to flexibly match the different-load operation conditions of the air conditioning unit.

Further, a thickness HT1 of the first heat exchange tube 11 and a thickness HT2 of the second heat exchange tube 13 may not be equal, so that the thicknesses of the first heat exchange tube 11 and the second heat exchange tube 13 can be adjusted according to the operation conditions of the air conditioning unit, so as to obtain different heat exchange performances of the two refrigeration loops of the heat exchanger.

Specifically, the width of the first heat exchange tube 11 and the width of the second heat exchange tube 13 satisfy the following condition: $0.2<D1*Tw2/Tw1*D2\leq 6$. D1 is the hydraulic diameter of the first tube 121, D2 is the hydraulic diameter of the second tube 141, Tw1 is the width of the first heat exchange tube 11, and Tw2 is the width of the second heat exchange tube 13.

Under the condition that the hydraulic diameter of the first tube 121 and the hydraulic diameter of the second tube 141 are different, and the width of the first heat exchange tube 11 and the width of the second heat exchange tube 13 are also different, by making the hydraulic diameters of the first tube 121 and the second tube 141 and the widths of the first heat exchange tube 11 and the second heat exchange tube 13 satisfy the above formula, the two refrigeration loops of the heat exchanger can maintain the sufficient system pressure, so as to ensure that the refrigerant has a sufficient flow rate for return, thus ensuring that the system has the best heat exchange performance.

Specifically, the hydraulic diameters of the first tube 121 and the second tube 141 are different, the ratio of the hydraulic diameter D1 of the first tube 121 to the hydraulic diameter D2 of the second tube 141 is greater than 1 and less than or equal to 4, and the ratio of the width Tw1 of the first heat exchange tube to the width Tw2 of the second heat exchange tube is greater than 1 and less than or equal to 3.

In some embodiments, under the condition that the hydraulic diameters of the first tube 121 and the second tube 141 are different and the widths of the first heat exchange tube 11 and the second heat exchange tube 13 are the same, by making the hydraulic diameters of the first tube 121 and the second tube 141 satisfy the above formula, the heat exchange capacity of the refrigerant in the first tube 121 with the large hydraulic diameter can be enhanced, so that two refrigeration loops with different heat exchange capacities can be obtained, which is beneficial to matching the different-load operation conditions of the air conditioning unit.

It should be noted that, generally, based on the existing technological level, when the heat exchanger 1 is brazed in a brazing furnace, the first tube 121 is located above the second tube 141, which however will cause differences in brazing parameters at the first tube 121 and the second tube 141. In order to ensure the good welding of the second tube 141, the first tube 121 will be over-welded, which will lead to too much solder entering the first tube 121, thus causing the risk of blocking the nozzle of the first heat exchange tube 11. If the nozzle of the first heat exchange tube 11 is blocked, the heat exchange performance of the heat exchanger 1 will be affected.

Figure 3:
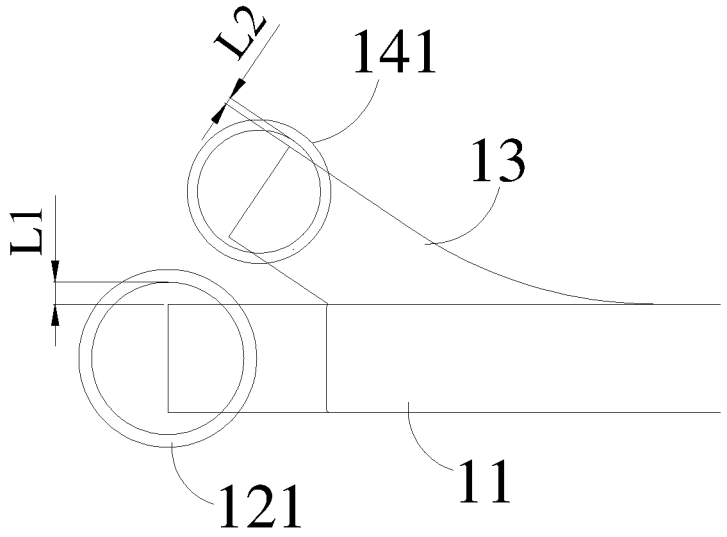
FIG. 3 is a sectional view of a part of the heat exchanger shown in FIG. 1.
Figure 4:
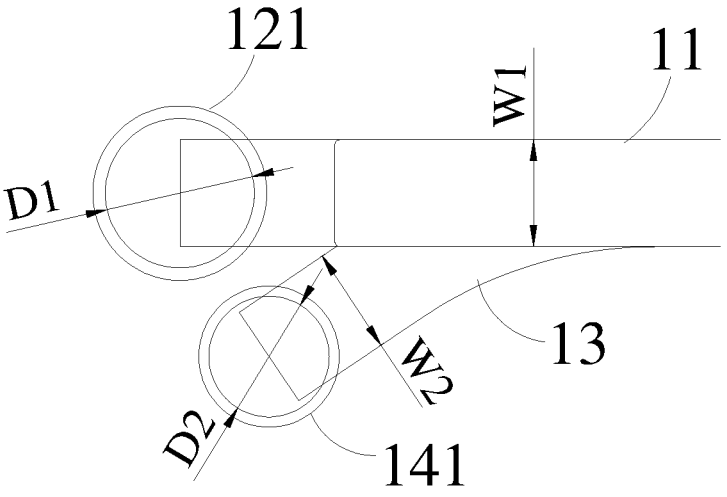
FIG. 4 is a sectional view of a part of the heat exchanger shown in FIG. 1.
Figure 5:
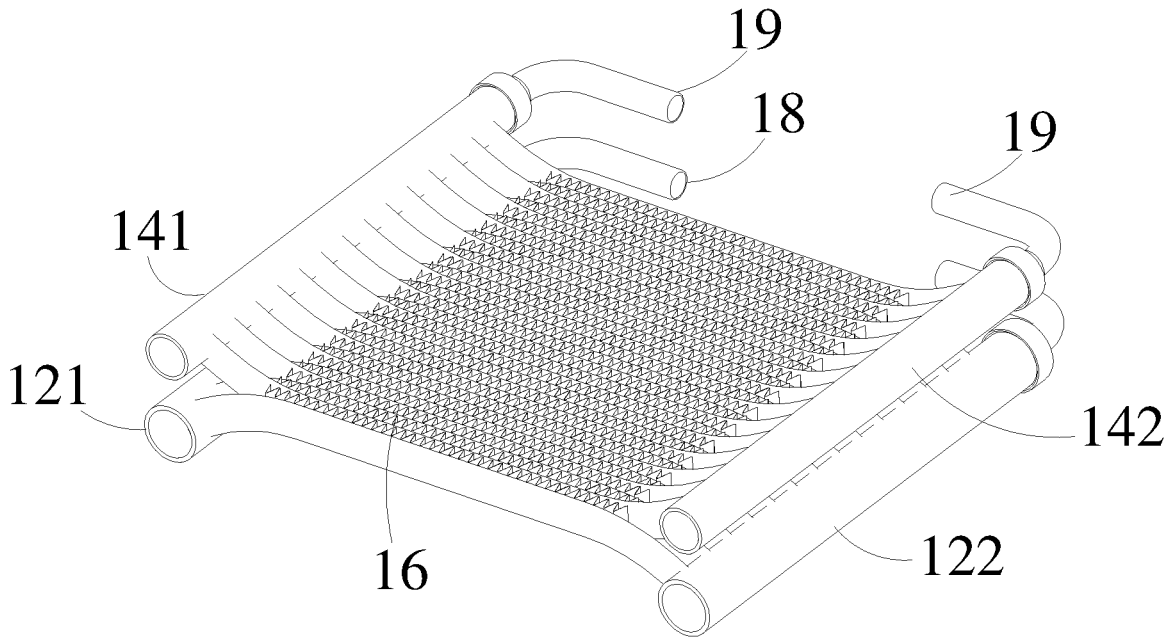
FIG. 5 is a schematic view of a heat exchanger according to another embodiment of the present disclosure.
Figure 6:
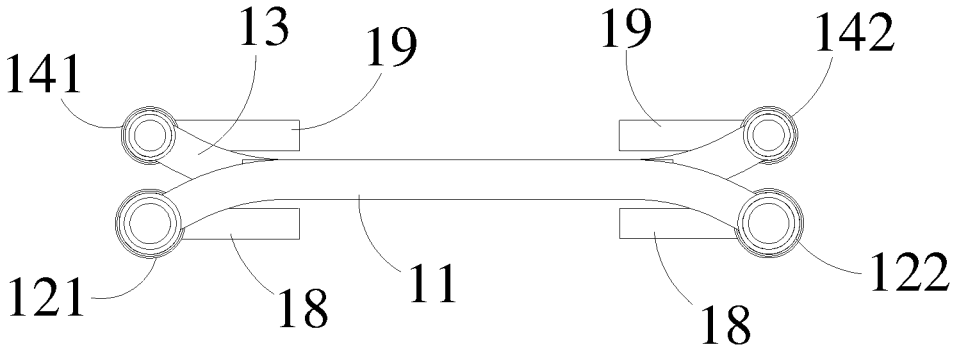
FIG. 6 is a bottom view of the heat exchanger shown in FIG. 5.
Figure 7:
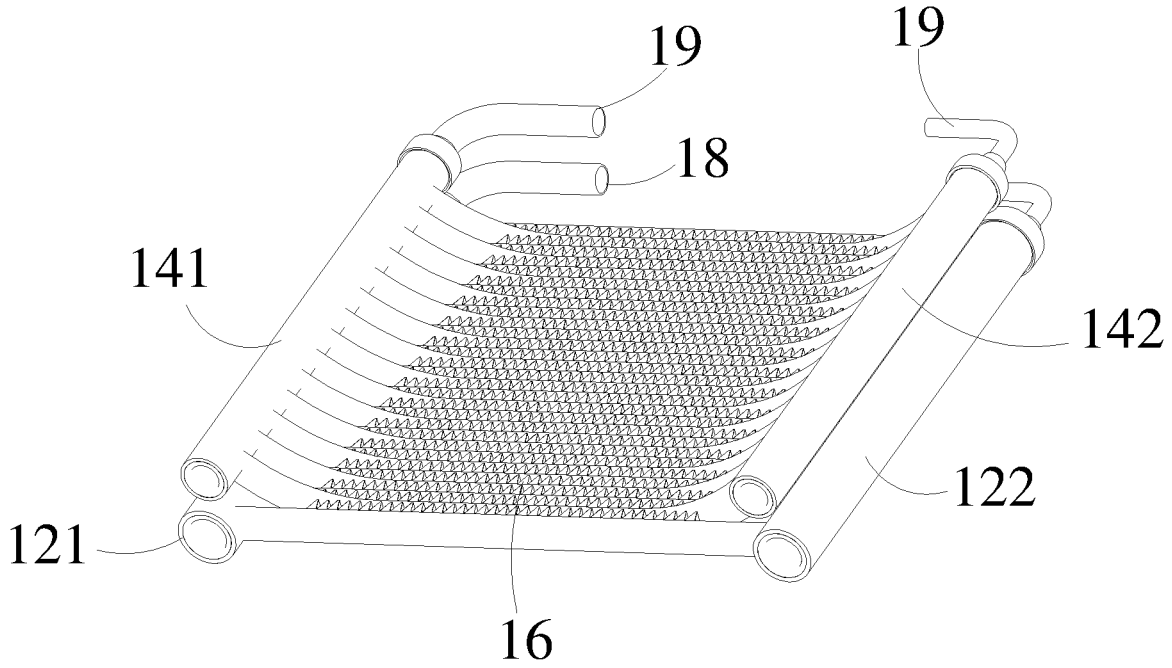
FIG. 7 is a schematic view of a heat exchanger according to another embodiment of the present disclosure.
Figure 8:
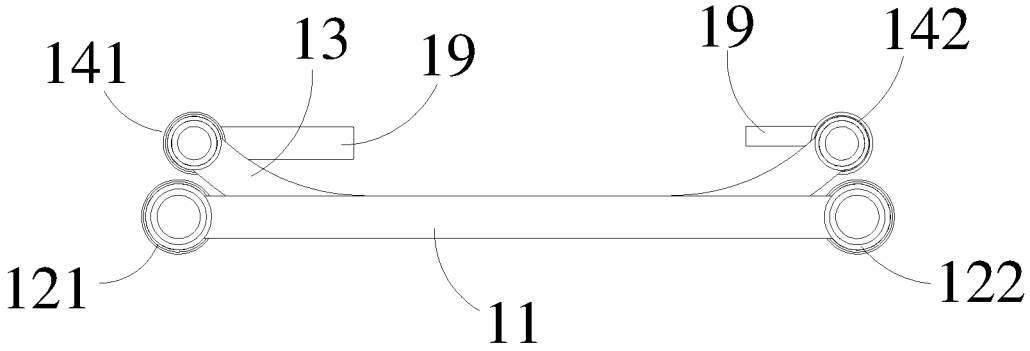
FIG. 8 is a bottom view of the heat exchanger shown in FIG. 7.
Figure 9:
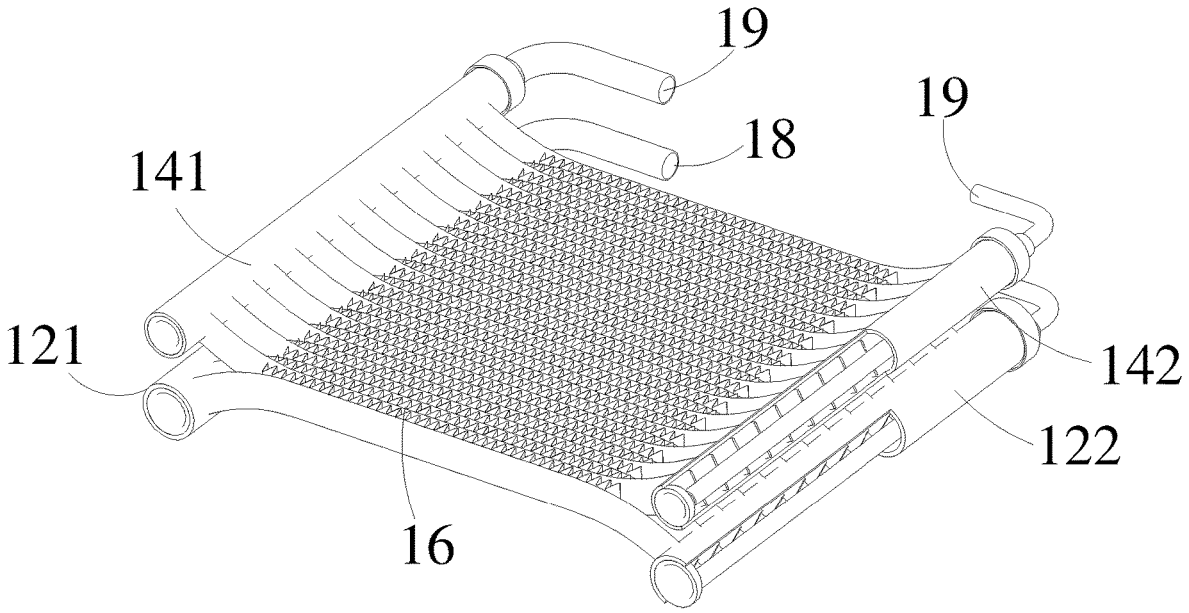
FIG. 9 is a schematic view of a heat exchanger according to yet another embodiment of the present disclosure.
Figure 10:
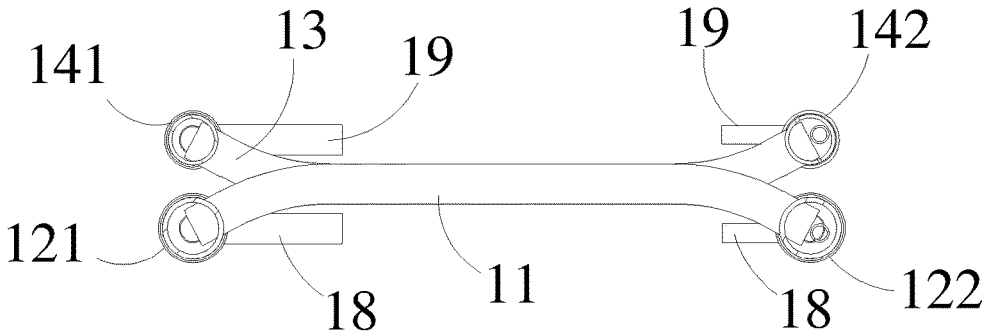
FIG. 10 is a bottom view of the heat exchanger shown in FIG. 9.
Figure 11:
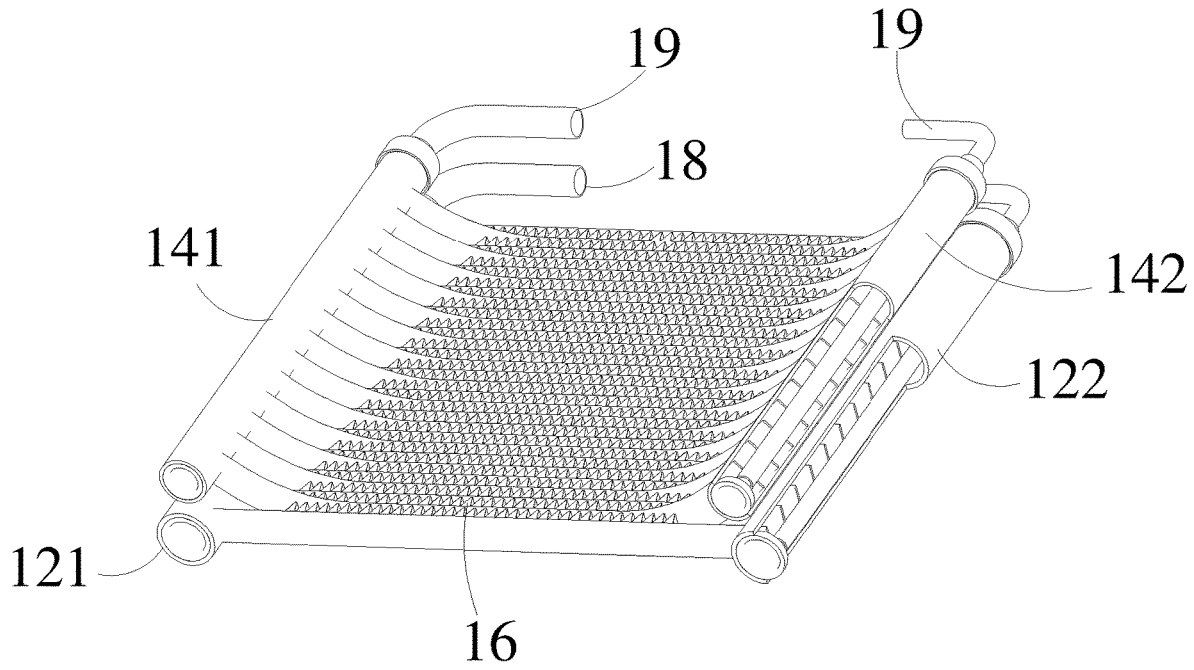
FIG. 11 is a schematic view of a heat exchanger according to another embodiment of the present disclosure.
Figure 12:
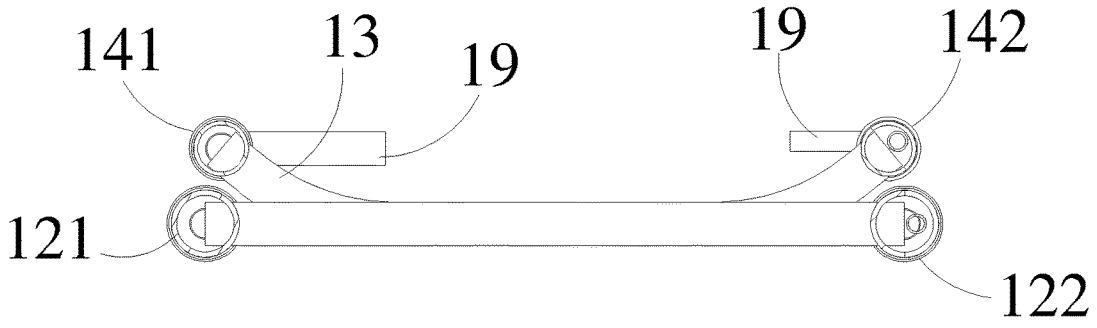
FIG. 12 is a bottom view of the heat exchanger shown in FIG. 11.

For this reason, in some embodiments, as shown in FIGS. 3 and 4, a distance L1 between an inner wall of the first tube 121 and the first heat exchange tube 11 is larger than a distance L2 between an inner wall of the second tube 141 and the second heat exchange tube 13. Generally, the first tube 121 and the second tube 141 are cylindrical, while the first heat exchange tube 11 and the second heat exchange tube 13 are microchannel flat tubes having opposite flat surfaces. In this case, the distance L1 is between the flat surface of the first heat exchange tube 11 and the highest or lowest point of the inner wall of the first tube 121 in a direction perpendicular to the flat surface of the first heat exchange tube 11, while the distance L2 is between the flat surface of the second heat exchange tube 13 and the highest or lowest point of the inner wall of the second tube 141 in a direction perpendicular to the flat surface of the second heat exchange tube 13. Therefore, an edge of the first heat exchange tube 11 is far away from an inner wall surface of the first tube, and even if the solder enters the first tube 121, the solder will accumulate between the first tube 121 and the first heat exchange tube 11, instead of blocking the nozzle of the first heat exchange tube 11.

In some embodiments, as shown in FIG. 3, by increasing the hydraulic diameter of the first tube 121, the distance L1 between the inner wall of the first tube 121 and the first heat exchange tube 11 can be larger than the distance L2 between the inner wall of the second tube 141 and the second heat exchange tube 13. At the same time, by increasing the hydraulic diameter of the first tube 121, it is also beneficial for the gas refrigerant to exchange heat, thus improving the heat exchange performance of the first heat exchange tube 11.

Specifically, along the length direction of the first tube 121, a minimum distance between two adjacent first heat exchange tubes 11 is Tp1, a minimum distance between two adjacent second heat exchange tubes 13 is Tp2, Tp1 and Tp2 are not equal, and the hydraulic diameter D1 of the first tube 121 and the hydraulic diameter D2 of the second tube 141 satisfy the following conditions:

$$0.2<D1\times Tp2/Tp1\times D2\leq 30;\ 0.2<Tp2/Tp1\leq 5.$$

It can be understood that there are a plurality of first heat exchange tubes 11 and a plurality of second heat exchange tubes 13 respectively, and the plurality of first heat exchange tubes 11 and the plurality of second heat exchange tubes 13 are alternately arranged. Specifically, there may be at least one first heat exchange tube 11 between every two second heat exchange tubes 13. For example, two, three or more first heat exchange tubes 11 are arranged between every two second heat exchange tubes 13, so that the first heat exchange tubes 11 and the second heat exchange tubes 13 can be evenly distributed, so as to ensure the uniformity of the air output temperature. Certainly, there may be at least one second heat exchange tube 13 between every two first heat exchange tubes 11.

Different tube pitches can realize the differential matching of the partial load. For example, a ratio of the number of the first heat exchange tubes 11 to the number of the second heat exchange tubes 13 can be 1:1, 2:1, 3:2, etc., so as to meet the operation conditions of the air conditioning unit under different loads.

Specifically, the first tube 121 includes a peripheral wall and a main channel surrounded by the peripheral wall. Along a length direction of the first heat exchange tube 11, a finless area section 17 is formed between the peripheral wall of the first tube 121 and part of the fins 16. It is defined that a side of the heat exchanger 1 located upstream in a wind direction during operation is a windward side, and a side of the heat exchanger 1 located downstream in the wind direction during operation is a leeward side. At least part of the second tube 141 is located on the windward or leeward side of the finless area section 17, that is, the projection of the second tube 141 is located between the fin 16 and the first tube 121.

The finless area section 17 can ensure that both the first heat exchange tube 11 and the second heat exchange tube 13 can be effectively welded and fixed with the fins 16. However, the wind passing through the finless area section 17 cannot participate in the heat exchange, and if the finless area section 17 is too large, the wind will be lost from here, resulting in a decrease in the heat exchange performance. Therefore, in some embodiments, by locating at least part of the second tube 141 on the windward side or the leeward side of the finless area section 17, the wind blowing to the finless area section 17 can contact with the second tube 141 to exchange heat, and at the same time, the wind can be guided to the fins 16 to exchange heat by being blocked by the second tube 141, thus improving the heat exchange efficiency. In addition, when the heat exchanger 1 passes through the furnace (i.e. being brazed), it is more convenient to brush the brazing flux between the first heat exchange tube 11 and the first tube 121, thereby ensuring the welding quality between the first heat exchange tube 11 and the first tube 121.

Specifically, a first distribution tube 18 is located in the main channel of the first tube 121, and the first distribution tube 18 extends by a certain distance along the length direction of the first tube 121. The second tube 141 includes a peripheral wall and a main channel surrounded by the peripheral wall, a second distribution tube 19 is located in the main channel of the second tube 141, and the second distribution tube 19 extends by a certain distance along a length direction of the second tube 141. The hydraulic diameter of the first distribution tube 18 is D3. The hydraulic diameter of the second distribution tube 19 is D4. D3 and D4 satisfy the following condition: $1\leq D3/D4\leq 4$, and such ratio can be 2 or 3, so that the gas-liquid two-phase refrigerant can flow into the corresponding tube uniformly.

Specifically, the width of the fin 16 is Fw, the width of the first heat exchange tube 11 is Tw1, and the width of the second heat exchange tube 13 is Tw2, which satisfy the following condition: $Tw2<Fw\leq Tw1+Tw2$. Under this relation, the fins, the first heat exchange tube 11 and the second heat exchange tube 13 can be combined into an optimal configuration, and the heat exchange efficiency of the heat exchanger can be improved.

In some embodiments, the first tube 121 includes a first channel 1211 the second tube 141 includes a second channel 1411, the first channel 1211 is communicated with the first heat exchange tube 11, the second channel 1411 is communicated with the second heat exchange tube 13, and the maximum length of the first channel 1211 in the length direction of the first tube 121 is greater than or less than the maximum length of the second channel 1411 in the length direction of the second tube 141. In some embodiments, the description is made by taking an example in which the maximum length of the first channel 1211 in the length direction of the first tube 121 is smaller than the maximum length of the second channel 1411 in the length direction of the second tube 141.

In the heat exchanger with double refrigeration systems commonly used, the lengths of the first tube 121 and the second tube 141 are generally the same, so that the heat exchange unit including the first tube 121 and the heat exchange unit including the second tube 141 have the same heat exchange capacity. However, in some embodiments, the maximum length of the first channel 1211 in the length direction of the first tube 121 is smaller than the maximum length of the second channel 1411 in the length direction of the second tube 141, so that the number of the first heat exchange tubes 11 connected to the first tube 121 is smaller than the number of the second heat exchange tubes 13 connected to the second tube 141, and the heat exchange performance of the fins 16 can be better utilized when the second heat exchange tubes 13 work. Thus, the heat exchange unit including the first tube 121 and the heat exchange unit including the second tube 141 have different heat exchange capabilities. When the multiple-refrigeration-system air conditioning unit needs to operate with the partial load, the heat exchange unit including the first tube 121 or the heat exchange unit including the second tube 141 can be started to operate according to the actual situation, so as to match various operation conditions according to environmental requirements. Certainly, by increasing or shortening the length of the first channel 1211 in the first tube 121, the number and the positions of the first heat exchange tubes 11 connected to the first channel 1211 can be changed, so that the heat exchange capacity of the heat exchange unit including the first tube 121 and the heat exchange capacity of the whole multiple-refrigeration-system air conditioning unit can be changed, and thus the multiple-refrigeration-system air conditioning unit can meet various requirements of different-load operations, thereby improving the adaptability of the heat exchanger to the multiple-refrigeration-system air conditioning unit during operation with the partial load, which is beneficial to improving the heat exchange performance under the partial-load operation condition.

In some embodiments, the hydraulic diameter of the first tube 121 is smaller than the hydraulic diameter of the second tube 141, and/or the hydraulic diameter of the third tube 122 is smaller than the hydraulic diameter of the fourth tube 142.

In some embodiments, the width of the first heat exchange tube 11 is greater than the width of the second heat exchange tube 13, and/or the length of the second heat exchange tube 13 is greater than the length of the first heat exchange tube 11.

The hydraulic diameters of the first tube 121 and the second tube 141 may be different, and the hydraulic diameters of the third tube 122 and the fourth tube 142 may also be different. Specifically, the hydraulic diameter of the first tube 121 is smaller than the hydraulic diameter of the second tube 141, and/or the hydraulic diameter of the third tube 122 is smaller than the hydraulic diameter of the fourth tube 142. In addition, the widths and lengths of the first heat exchange tube 11 and the second heat exchange tube 13 may also be different. Specifically, the width of the first heat exchange tube 11 is greater than the width of the second heat exchange tube 13, and/or the length of the second heat exchange tube 13 is greater than the length of the first heat exchange tube 11. Therefore, different heat exchange flow paths of the heat exchanger can have different heat exchange performances.

In some embodiments, the length of the first tube 121 is smaller than the length of the second tube 141, and the number of the first heat exchange tubes 11 communicating with the first channel 1211 is smaller than the number of the second heat exchange tubes communicating with the second channel 1411.

Figure 13:
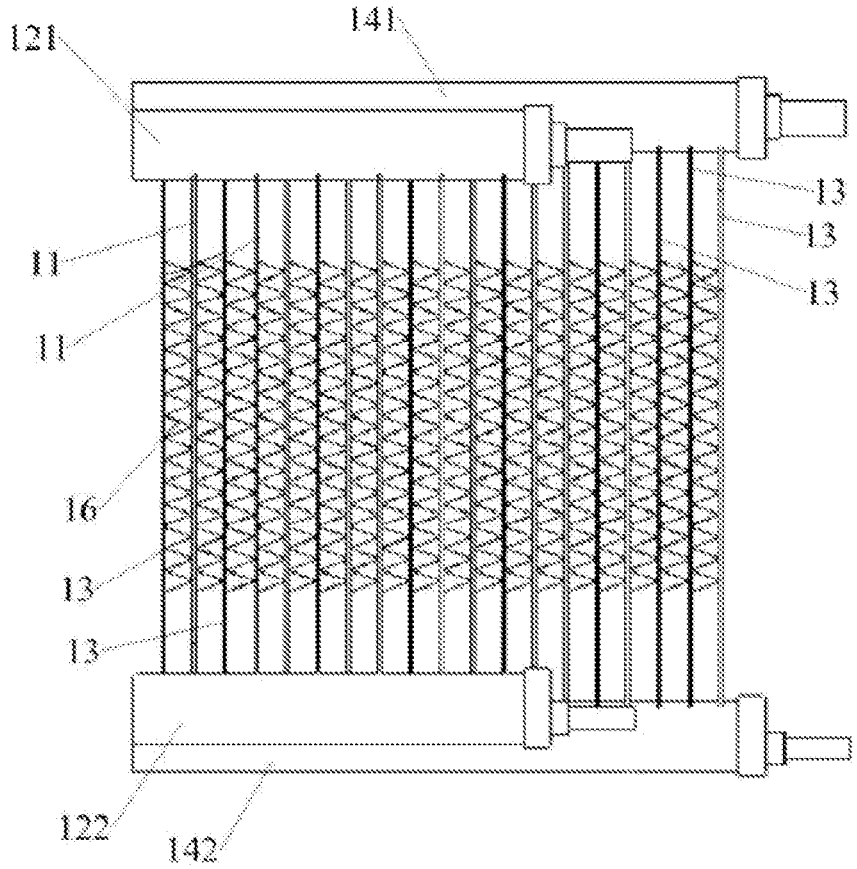
FIG. 13 is a schematic view of a heat exchanger according to a specific embodiment of the present disclosure.
Figure 14:
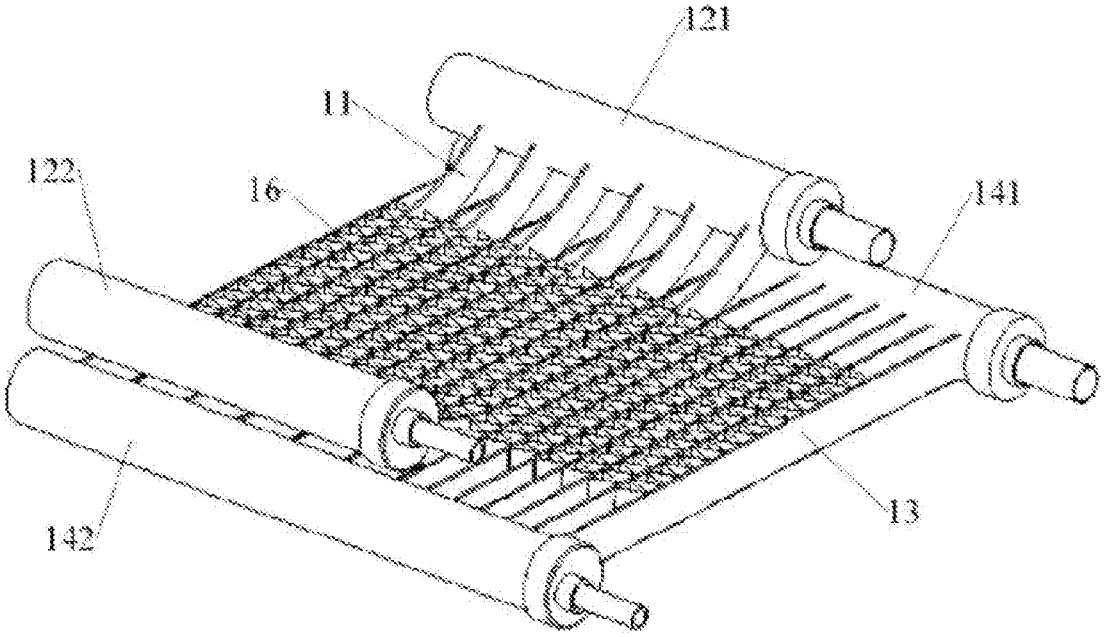
FIG. 14 is a perspective view of the heat exchanger shown in FIG. 13.
Figure 15:
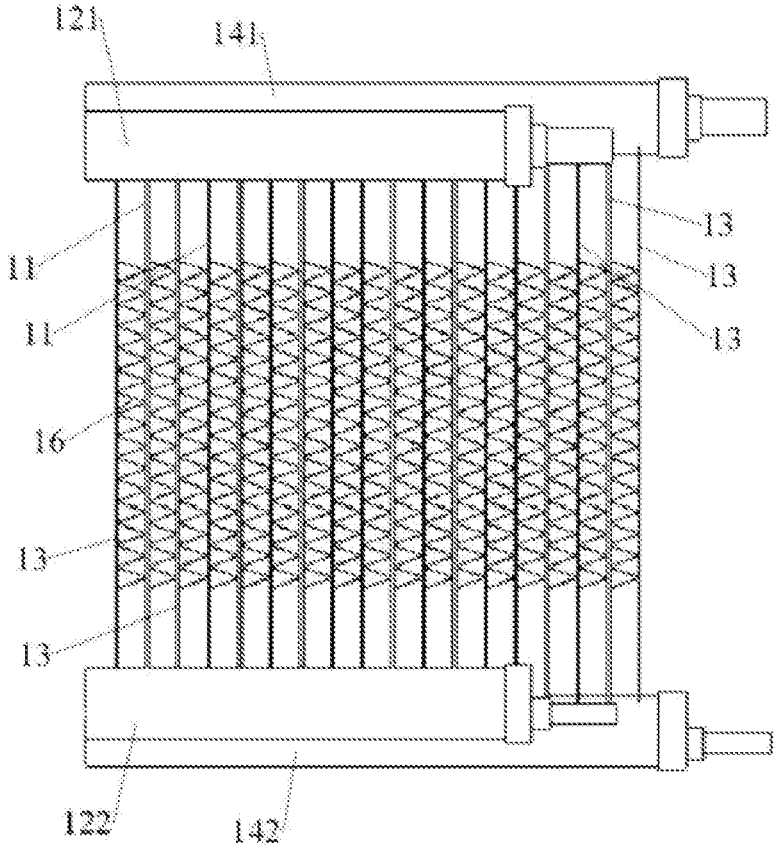
FIG. 15 is a schematic view of a heat exchanger according to a specific embodiment of the present disclosure.
Figure 16:
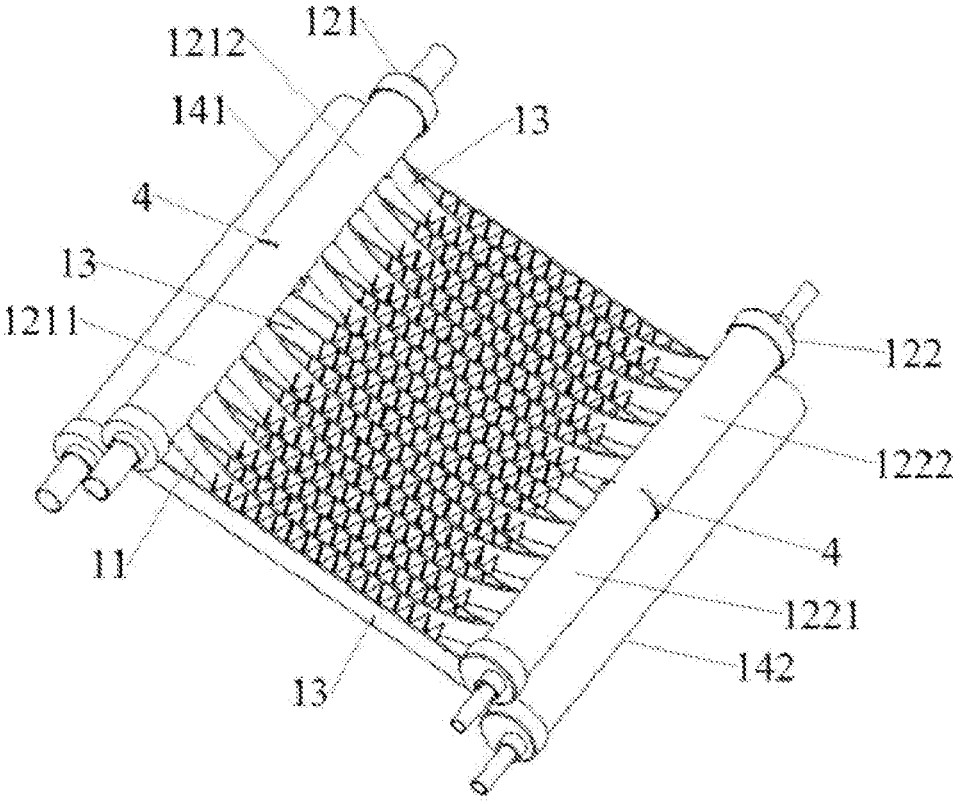
FIG. 16 is a schematic view of a heat exchanger according to a specific embodiment of the present disclosure.
Figure 17:
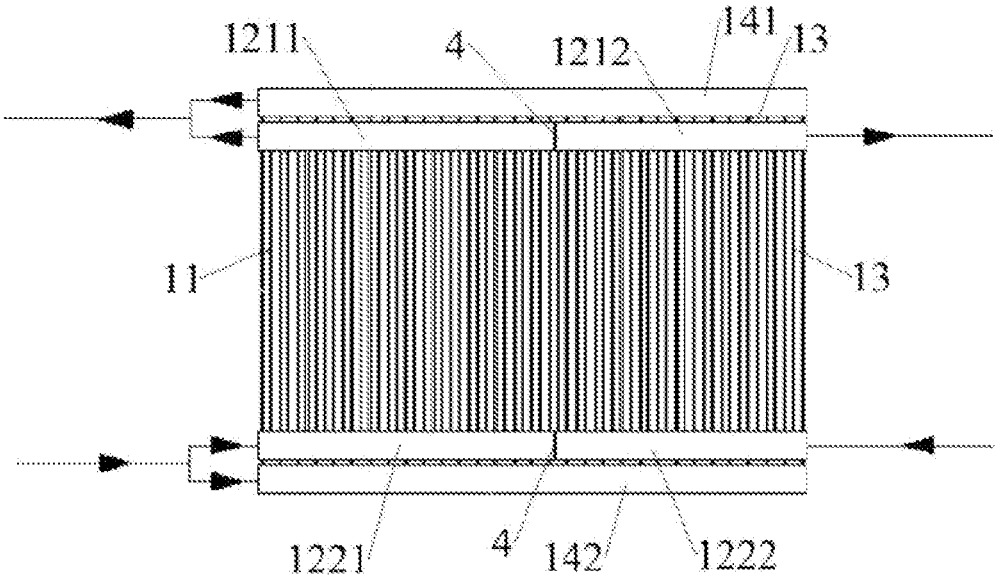
FIG. 17 is a schematic view of a flow path of the heat exchanger shown in FIG. 16.
Figure 18:
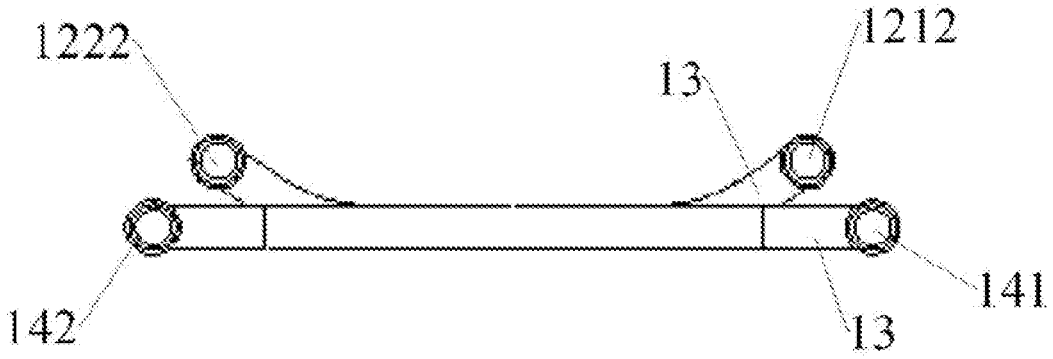
FIG. 18 is a right view of the heat exchanger shown in FIG. 17.
Figure 19:
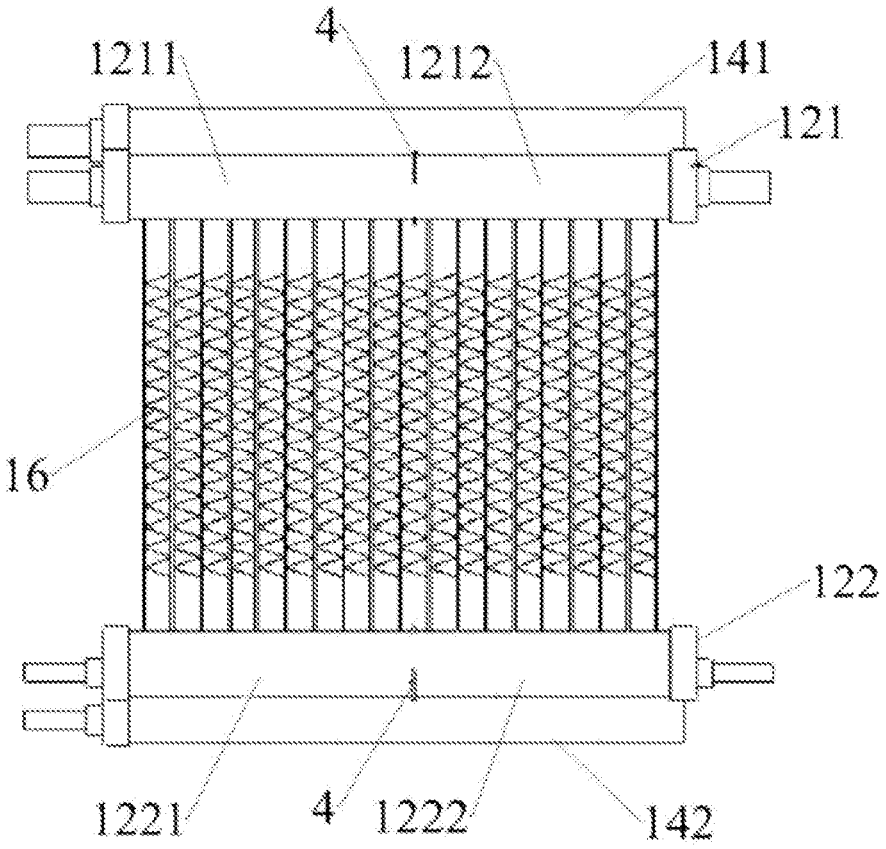
FIG. 19 is a front view of the heat exchanger shown in FIG. 17.
Figure 20:
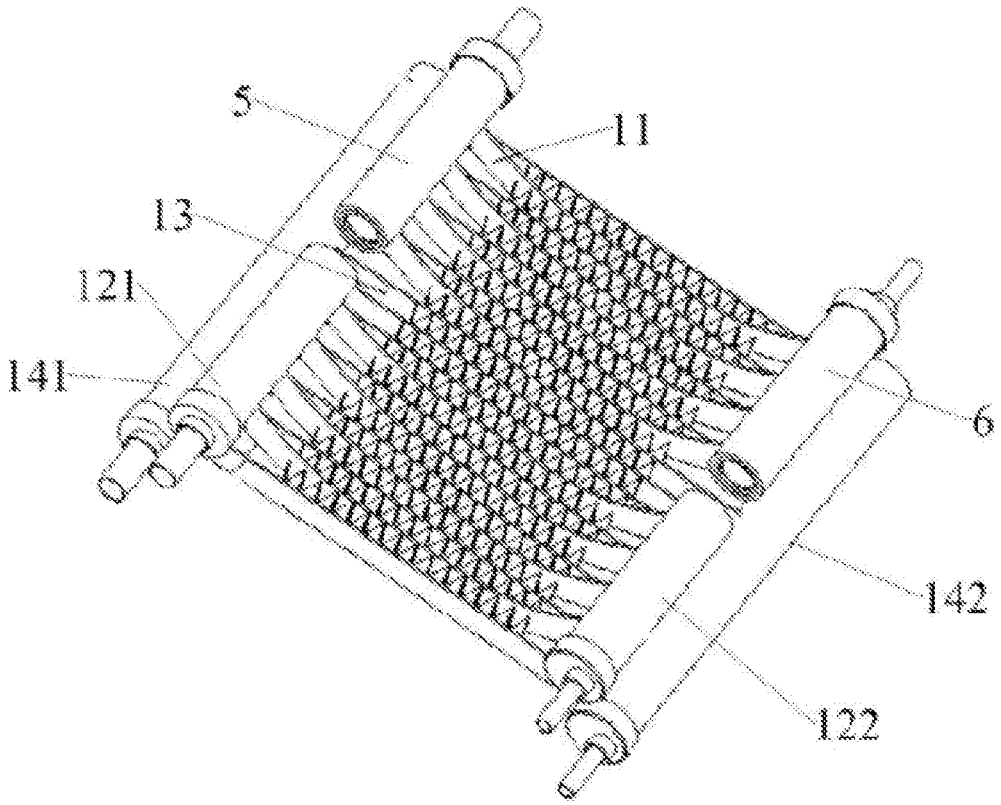
FIG. 20 is a schematic view of a heat exchanger according to another specific embodiment of the present disclosure.
Figure 21:
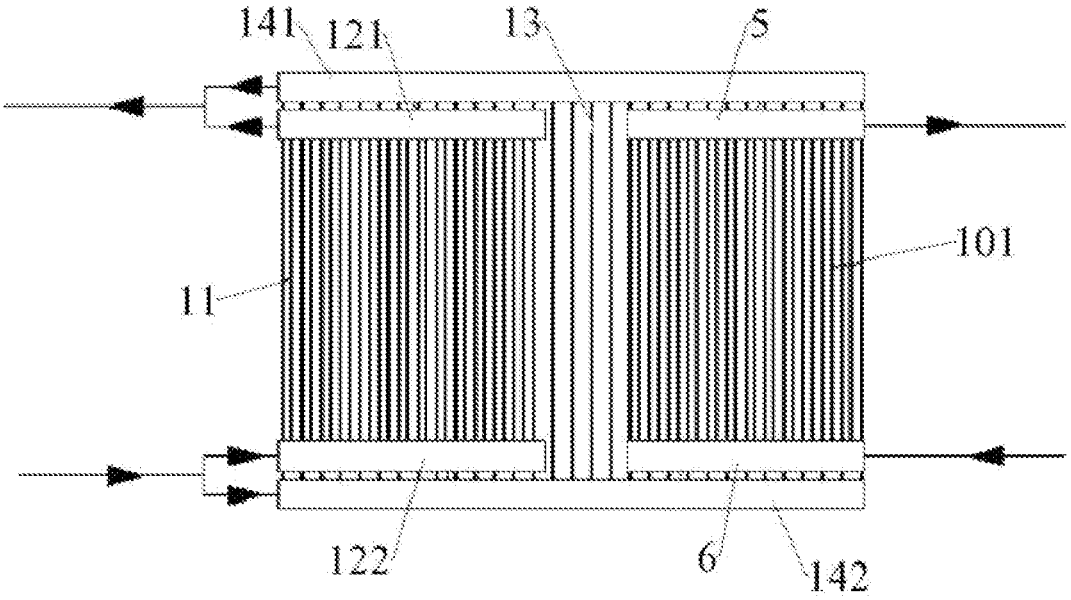
FIG. 21 is a schematic view of a flow path of the heat exchanger shown in FIG. 20.
Figure 22:
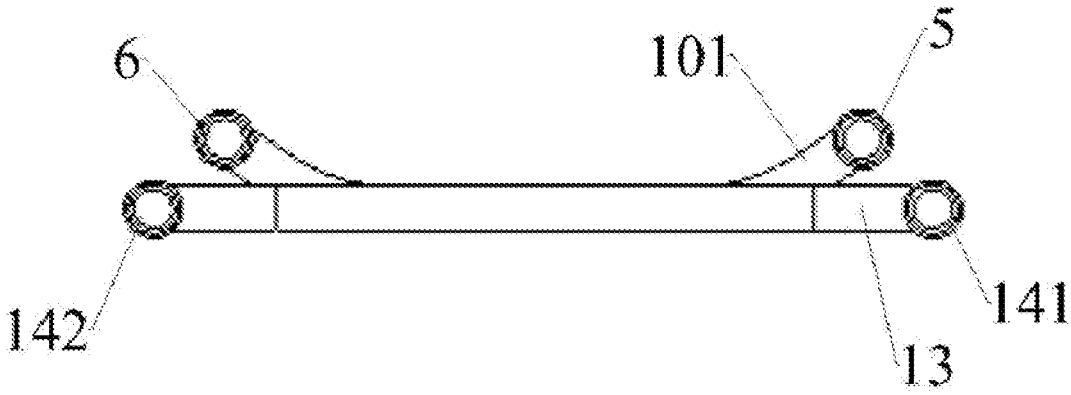
FIG. 22 is a right view of the heat exchanger shown in FIG. 21.
Figure 23:
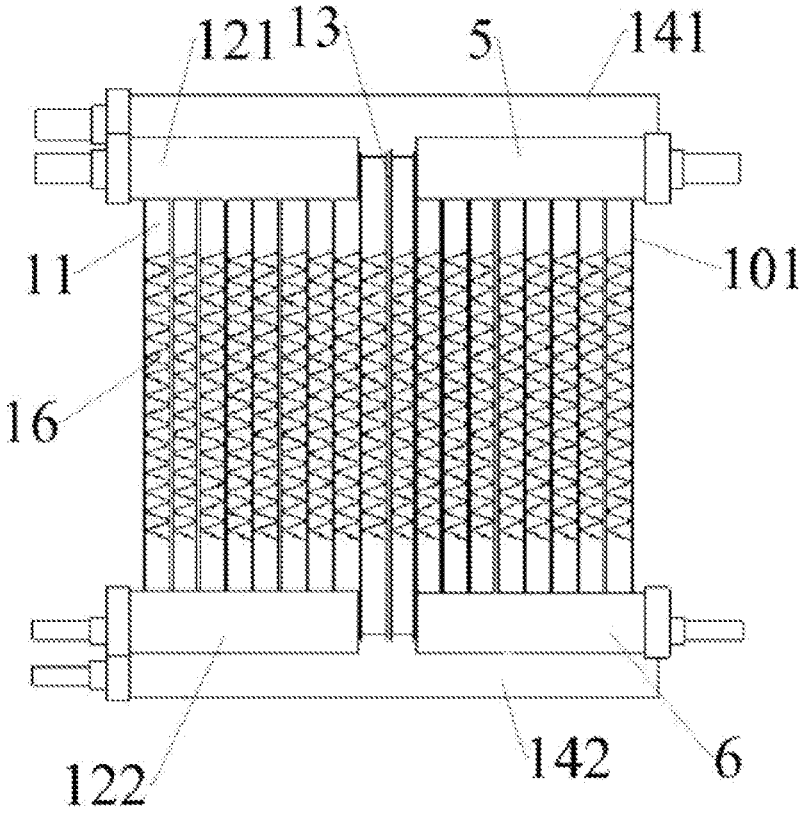
FIG. 23 is a front view of the heat exchanger shown in FIG. 21.
Figure 24:
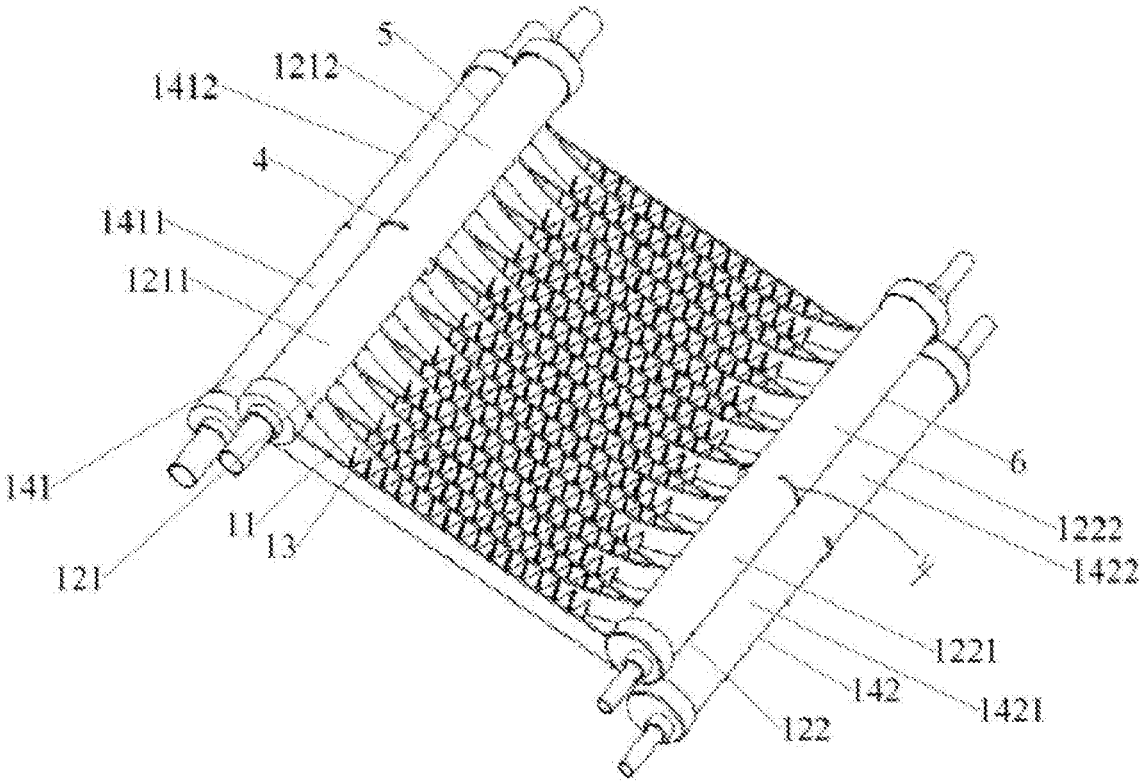
FIG. 24 is a schematic view of a heat exchanger according to another specific embodiment of the present disclosure.
Figure 25:
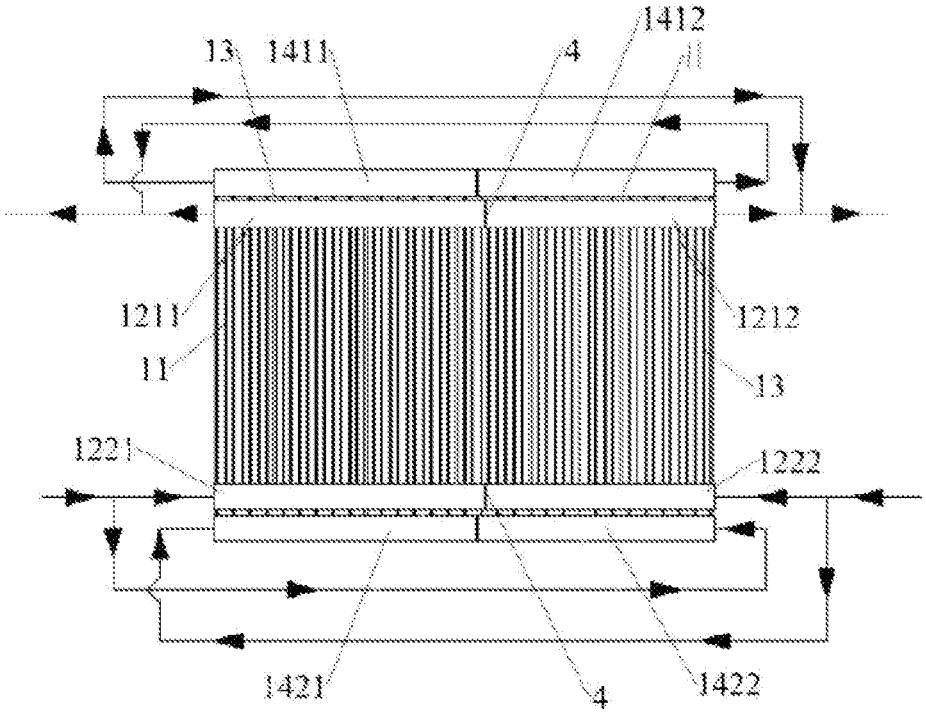
FIG. 25 is a schematic view of a flow path of the heat exchanger shown in FIG. 24.
Figure 26:
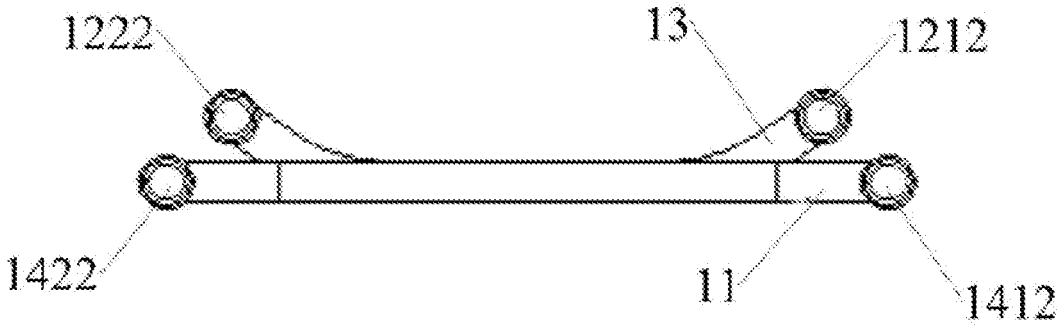
FIG. 26 is a right view of the heat exchanger shown in FIG. 25.
Figure 27:
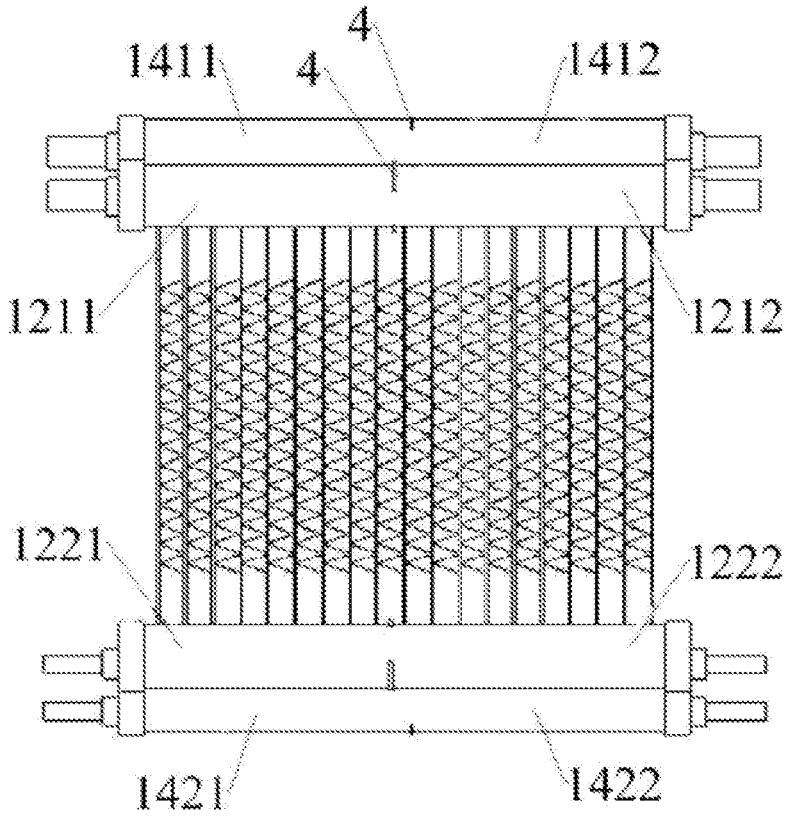
FIG. 27 is a front view of the heat exchanger shown in FIG. 25.
Figure 28:
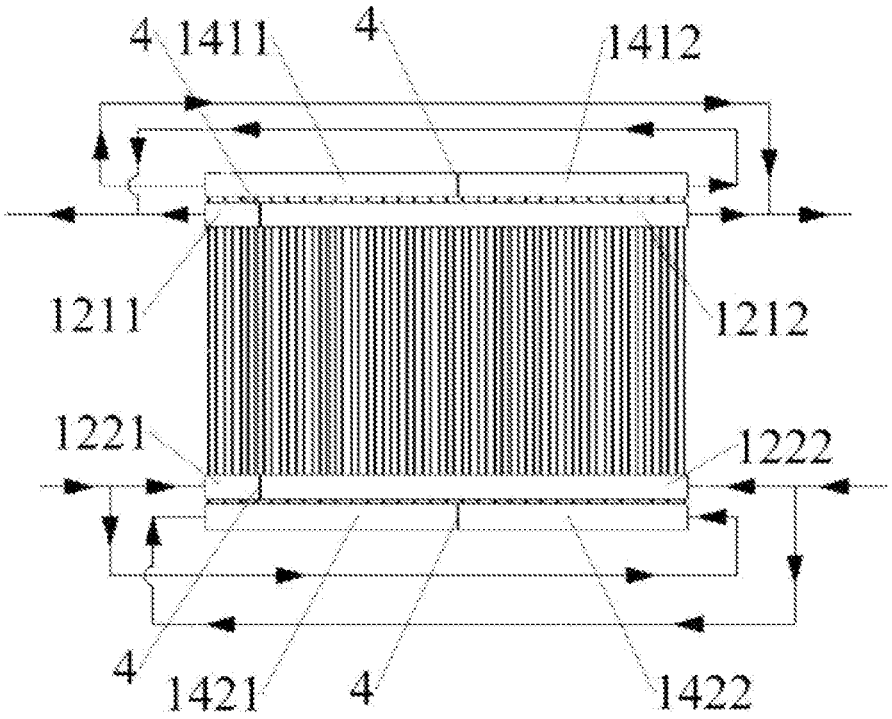
FIG. 28 is a schematic view of another flow path of the heat exchanger shown in FIG. 24.

In some embodiments, as shown in FIGS. 13 to 15, the length of the first channel 1211 is equal to the length of the first tube 121 and the length of the second channel 1411 is equal to the length of the second tube 141. It can be understood that the first channel 1211 extends in an axial direction of the first tube 121 and the second channel 1411 extends in an axial direction of the second tube 141. The length of the first tube 121 is smaller than the length of the second tube 141, the number of the first heat exchange tubes 11 communicating with the first channel 1211 is different from the number of the second heat exchange tubes 13 communicating with the second channel 1411, and the first heat exchange tubes 11 communicate the first tube 121 with the third tube 122.

In some embodiments, the ratio of the number of the first heat exchange tubes 11 communicating with the first channel 1211 to the number of the second heat exchange tubes 13 communicating with the second channel 1411 is 6:13. In some other embodiments, the ratio of the number of the first heat exchange tubes 11 communicating with the first channel 1211 to the number of the second heat exchange tubes 13 communicating with the second channel 1411 is 7:12.

In some embodiments, a plurality of first heat exchange tubes 11 communicate the first tube 121 with the third tube 122, and the plurality of first heat exchange tubes 11 are arranged at intervals along the length direction of the first tube 121. Since the length of the first tube 121 is relatively short, the number of the first heat exchange tubes 11 can be reduced, and the interval between adjacent first heat exchange tubes 11 is relatively small, which is beneficial to improving the heat exchange performance of the fins placed between the heat exchange tubes. When the heat exchanger is used as an evaporator, the shorter first tube 121 is beneficial to reducing the gas-liquid separation. In addition, a plurality of second heat exchange tubes 13 communicate the second tube 141 with the fourth tube 142, and different numbers of the second heat exchange tubes 13 are matched according to the design of the system and the situation of the compressor, which is beneficial to improving the energy efficiency of the system.

It should be noted that, since the number of the first heat exchange tubes 11 communicating with the first channel 1211 is smaller than the number of the second heat exchange tubes 13 communicating with the second channel 1411, the heat exchange capacity of the heat exchange unit including the first tube 121 is smaller than the heat exchange capacity of the heat exchange unit including the second tube 141. When the multiple-refrigeration-system air conditioning unit needs to operate with the partial load, the heat exchange unit including the second tube 141 with the strong heat exchange capacity or the heat exchange unit including the first tube 121 with the weak heat exchange capacity can be selected to operate according to the requirements of the partial-load operation, so that various operation conditions can be matched according to the environmental requirements.

In some embodiments, the second tube 141 is disposed adjacent to the first tube 121 relative to the third tube 122, the fourth tube 142 is disposed adjacent to the third tube 122 relative to the first tube 121, and the length of the third tube 122 is smaller than the length of the fourth tube 142. The first tube 121, the third tube 122 and the first heat exchange tube 11 can form a heat exchange unit, the second tube 141, the fourth tube 142 and the second heat exchange tube 13 can form a heat exchange unit, and the two heat exchange units have different heat exchange capabilities, so that any one of the two heat exchange units can be selected to operate more flexibly when the multiple-refrigeration-system air conditioning unit operates with the partial load. The lengths of the first tube 121 and the third tube 122 may be equal, and the lengths of the second tube 141 and the fourth tube 142 may be equal.

In some embodiments, as shown in FIGS. 16 to 19, the first tube 121 includes a third channel 1212, the third channel 1212 is communicated with the second heat exchange tube 13, the third channel 1212 is not communicated with the first channel 1211, and the first channel 1211 and the third channel 1212 are arranged along the length direction of the first tube 121. Part of the third tube 122 is communicated with the first heat exchange tube 11 and the first channel 1211, while the other part of the third tube 122 is communicated with the second heat exchange tube 13 and the third channel 1212. The first tube 121 includes a baffle plate 4, and the baffle plate 4 separates the first channel 1211 from the third channel 1212.

The second tube 141, the second heat exchange tube 13 and the fourth tube 142 can form a first flow path, the first channel 1211, a channel in the first heat exchange tube 11 and a channel in part of the third tube 122 can form a second flow path, and the third channel 1212, a channel in the second heat exchange tube 13 and a channel in the other part of the third tube 122 can form a third flow path. The heat exchange capacities of the heat exchange unit including the second flow path and the heat exchange unit including the third flow path can be the same or different, so that the most matched heat exchange unit of the three refrigeration flow paths can be selected to operate according to the requirements of the operation with the actual load, and thus the multiple-refrigeration-system air conditioning unit can match (i.e. select or switch or adopt) various operation conditions according to environmental requirements, thereby improving the heat exchange efficiency.

Figure 29:
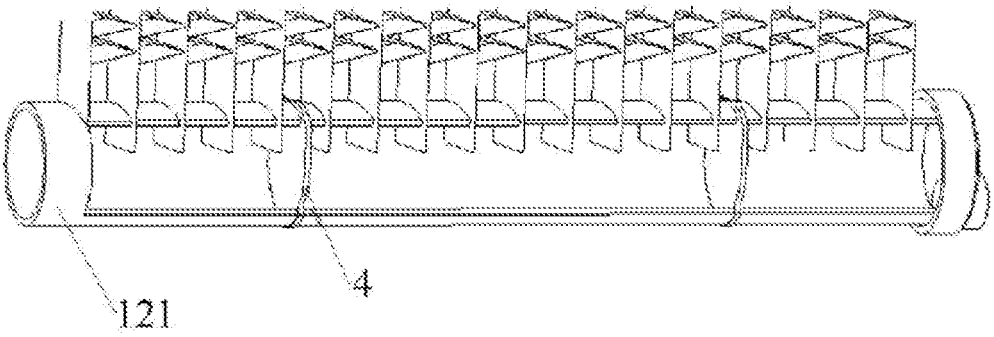
FIG. 29 is a state view of a baffle plate in a first tube.

It should be noted that the first tube 121 can be an integrally formed tube, and the baffle plate 4 is hermetically arranged, as shown in FIG. 29, to divide the channel in the first tube 121 into two sections, so that the first channel 1211 and the second channel 1411 are formed on both sides of the baffle plate 4, respectively.

In some embodiments, as shown in FIGS. 20 to 23, the heat exchanger further includes a fifth tube 5 and a sixth tube 6, and the heat exchange tube further includes a third heat exchange tube 101. The third heat exchange tube 101 communicates the fifth tube 5 with the sixth tube 6, and the fifth tube 5 and the first tube 121 are not communicated with each other. The length of the fifth tube 5 is smaller than the length of the second tube 141, and the number of the third heat exchange tubes 101 is smaller than the number of the second heat exchange tubes 13. In the length direction of the second tube 141, the second heat exchange tube 13 and the third heat exchange tube 101 are arranged at intervals.

The fifth tube 5 and the first tube 121 can be arranged coaxially, and the fifth tube 5 and the first tube 121 are arranged at intervals, so that the fifth tube 5 and the first tube 121 are not communicated with each other. The sixth tube 6 and the third tube 122 can be arranged coaxially, and the sixth tube 6 and the third tube 122 are arranged at intervals, so that the sixth tube 6 and the third tube 122 are not communicated with each other. In some embodiments, a first flow path can be formed by the channels in the first tube 121, in the first heat exchange tube 11 and in the third tube 122, a second flow path can be formed by the channels in the second tube 141, in the second heat exchange tube 13 and in the fourth tube 142, and a third flow path can be formed by the channels in the fifth tube 5, in the third heat exchange tube 101 and in the sixth tube 6. The length of the fifth tube 5 is smaller than the length of the second tube 141, and the number of the third heat exchange tubes 101 is smaller than the number of the second heat exchange tubes 13, so that the heat exchange capacity of the third flow path is smaller than the heat exchange capacity of the second flow path. In addition, the length of the first tube 121 and the length of the fifth tube 5 may be equal or unequal, and the number of the first heat exchange tubes 11 and the number of the third heat exchange tubes 101 may be equal or unequal, so that the heat exchange capacities of the first flow path and the third flow path are the same or different. Therefore, the heat exchange capacity of the multiple-refrigeration-system air conditioning unit can better adapt to various operation conditions with different loads.

In some embodiments, as shown in FIGS. 24 to 27, the second tube 141 includes a fourth channel 1412, and the fourth channel 1412 communicates with the first heat exchange tube 11. The second channel 1411 does not communicate with the fourth channel 1412, the first channel 1211 communicates with the fourth channel 1412, and the second channel 1411 communicates with the third channel 1212. Part of the third tube 122 is communicated with the first heat exchange tube 11 and the first channel 1211, and the other part of the third tube 122 is communicated with the second heat exchange tube 13 and the third channel 1212. Part of the fourth tube 142 communicates with the second heat exchange tube 13 and the second channel 1411, and the other part of the fourth tube 142 communicates with the first heat exchange tube 11 and the fourth channel 1412. The sum of the number of the first heat exchange tubes 11 communicating with the first channel 1211 and the number of the first heat exchange tubes 11 communicating with the fourth channel 1412 is a first value, while the sum of the number of the second heat exchange tubes 13 communicating with the second channel 1411 and the number of the second heat exchange tubes 13 communicating with the third channel 1212 is a second value, and the first value and the second value are not equal.

In some embodiments, the first channel 1211, the channel in the first heat exchange tube 11 and the channel in part of the third tube 122 can form a first flow path, the third channel 1212, the channel in the second heat exchange tube 13 and the channel in the other part of the third tube 122 can form a second flow path, the second channel 1411, the channel in the second heat exchange tube 13 and the channel in part of the fourth tube 142 can form a third flow path, and the channel in the other part of the fourth tube 142, the channel in the first heat exchange tube 11 and the fourth channel 1412 may form a fourth flow path. One heat exchange unit includes the first flow path and the fourth flow path, and the other heat exchange unit includes the second flow path and the third flow path.

In some embodiments, the heat exchange capacity of each of the four refrigeration flow paths may be the same or different. Specifically, the sum of the number of the first heat exchange tubes 11 communicating with the first channel 1211 and the number of the first heat exchange tubes 11 communicating with the fourth channel 1412 can be defined as a first value, the sum of the number of the second heat exchange tubes 13 communicating with the second channel 1411 and the number of the second heat exchange tubes 13 communicating with the third channel 1212 can be defined as a second value, and the first value and the second value may not be equal. Therefore, the heat exchange capacities of the first heat exchange unit and the second heat exchange unit can be different. When the multiple-refrigeration-system air conditioning unit needs to operate with the partial load, the matched heat exchange unit can be selected to operate, and different numbers of the heat exchange tubes can be matched according to the design of the system and the situation of the compressor, which is beneficial to the improvement of the energy efficiency of the system. The second channel 1411 and the fourth channel 1412 may be separated by the baffle plate 4.

In some embodiments, the third tube 122 includes a fifth channel 1221 that communicates with the first channel 1211 via the first heat exchange tube, and a seventh channel 1222 that communicates with the third channel 1212 via the second heat exchange tube 13. The fourth tube 142 includes a sixth channel 1421 which communicates with the second channel 1411 via the second heat exchange tube 13, and an eighth channel 1422 which communicates with the fourth channel 1412 via the first heat exchange tube 11.

The first channel 1211, the channel in the first heat exchange tube 11 and the fifth channel 1221 can form a first flow path, the third channel 1212, the second heat exchange tube 13 and the seventh channel 1222 can form a second flow path, the second channel 1411, the second heat exchange tube 13 and the sixth channel 1421 can form a third flow path, and the fourth channel 1412, the first heat exchange tube 11 and the eighth channel 1422 can form a fourth flow path.

The present disclosure also provides a multi-system air conditioning unit, which includes the heat exchanger 1 provided by any embodiment of the present disclosure.

Figure 30:
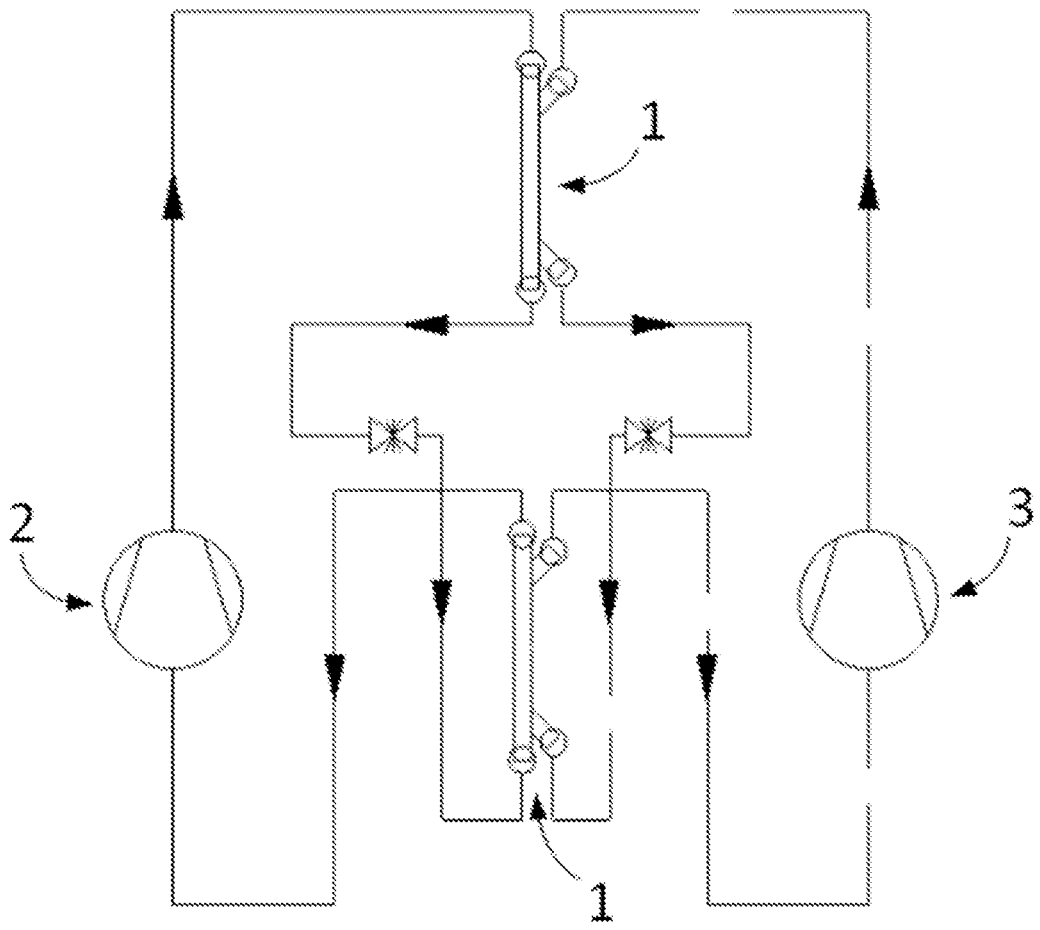
FIG. 30 is a schematic view of a multi-system air conditioning unit.

Another embodiment of the present disclosure also provides a multi-system air conditioning unit, as shown in FIG. 30, which includes the heat exchanger 1 provided by any embodiment of the present disclosure. The multi-system air conditioning unit includes a first system and a second system. The first system includes a first compressor set 2, and the first system communicates with the first tube 121 and the second tube 141 of the heat exchanger. The second system includes a second compressor set 3, and the second system communicates with the second tube 141 and the fourth tube 142 of the heat exchanger. The ratio of the output power of the first compressor set 2 to the output power of the second compressor set 3 is greater than 1.5 and less than or equal to 5.

The multi-system air conditioning unit according to the embodiments of the present disclosure includes a plurality of refrigeration systems, and at least two refrigeration systems of the multi-system air conditioning unit share at least one heat exchanger in any of the above embodiments. As shown in FIG. 13, the multi-system air conditioning unit 2 according to the embodiments of the present disclosure includes at least two refrigeration loops. In one refrigeration loop, the refrigerant flows out from the outlet of the first compressor set 2 and then enters the first tube 121 of the heat exchanger 1. The first tube 121 and the third tube 131 are communicated through the first heat exchange tube 11, the refrigerant flows out of the third tube 131 and then enters the first tube 121 and the third tube 131 of another heat exchanger 1, the first tube 121 and the third tube 131 of the other heat exchanger 1 are communicated through the first heat exchange tube 11, and the refrigerant flows out of the third tube 131 and then flows back to the inlet of the first compressor set 2, so as to realize the circulation of the refrigerant loop. In another refrigeration loop, the refrigerant flows out of the outlet of the second compressor set 3 and then enters the second tube 141 of the heat exchanger 1. The second tube 141 and the fourth tube 142 communicate with each other through the second heat exchange tube 13. The refrigerant flows out of the second tube 141 and then enters the second tube 141 of another heat exchanger 1. The second tube 141 and the fourth tube 142 of the other heat exchanger 1 communicate with each other through the second heat exchange tube 13. The refrigerant flows out of the fourth tube 142 and then flows back to the inlet of the second compressor set 3, so as to realize the circulation of the refrigerant loop. Thus, the heat exchanger can improve the utilization rate of the heat exchange area, which is beneficial to improving the heat exchange performance of the system.

By making the two compressor sets have different output powers, the two systems can have different heat exchange capabilities, so that they can match the operation conditions of the air conditioning unit with different loads, and the output powers of the two compressor sets can be adjusted in the range of more than 1.5 and less than or equal to 5, so as to improve the adaptability of the heat exchanger to the multiple-refrigeration-system air conditioning unit during the operation with the partial load.

The above description only relates to the preferred embodiments of the present disclosure, which are not used to limit the present disclosure. For those skilled in the art, the present disclosure can be modified and varied. Any modification, equivalent substitution, improvement and so on made within the spirit and principle of the present disclosure shall be included in the protection scope of the present disclosure.

The invention claimed is:

1. A heat exchanger, comprising:

a first assembly, comprising a first tube and a third tube;

a second assembly, comprising a second tube and a fourth tube;

a plurality of heat exchange tubes, wherein each heat exchange tube is a microchannel flat tube, and comprises a plurality of channels arranged along a length direction of each heat exchange tube, and the plurality of channels are arranged at intervals in a width direction of each heat exchange tube, wherein the plurality of heat exchange tubes comprise a plurality of first heat exchange tubes and a plurality of second heat exchange tubes, wherein each of the plurality of first heat exchange tubes communicate the first tube with the third tube, the plurality of second heat exchange tubes communicate the second tube with the fourth tube, wherein the plurality of first heat exchange tubes and the plurality of second heat exchange tubes are arranged at intervals along a length direction of the first tube, wherein the first tube and the second tube are not communicated with each other, and the third tube and the fourth tube are not communicated with each other; and a plurality of fins, wherein part of each fin is connected with one of the plurality of first heat exchange tubes, and another part of each fin is connected with one of the plurality of second heat exchange tubes, wherein the plurality of first heat exchange tubes, the plurality of fins and the plurality of second heat exchange tubes are arranged along the length direction of the first tube, wherein the heat exchanger is configured in at least one of following manners:

a first hydraulic diameter of the first tube is D1, a second hydraulic diameter of the second tube is D2, and a ratio of the first hydraulic diameter to the second hydraulic diameter is greater than 1 and less than or equal to 6; and a width of each first heat exchange tube is Tw1, a width of each second heat exchange tube is Tw2, and a ratio of the width of each first heat exchange tube to the width of each second heat exchange tube is greater than 1 and less than or equal to 5, wherein the first tube comprises a first channel and a third channel defined therein, the third channel is communicated with the plurality of second heat exchange tubes and is not communicated with the first channel, the first channel and the third channel are arranged along the length direction of the first tube, part of the third tube is communicated with the plurality of first heat exchange tubes and the first channel, another part of the third tube is communicated with the plurality of second heat exchange tubes and the third channel, and the first tube includes a baffle plate which separates the first channel and the third channel, and wherein the second tube, the plurality of second heat exchange tubes and the fourth tube form a first flow path; the first channel, a channel in the plurality of first heat exchange tubes and a channel in the part of the third tube form a second flow path; and the third channel, a channel in the plurality of second heat exchange tubes and a channel in the another part of the third tube form a third flow path.

2. The heat exchanger according to claim 1, wherein a thickness of each first heat exchange tube is not equal to a thickness of each second heat exchange tube.

3. The heat exchanger according to claim 1, wherein the width of each first heat exchange tube and the width of each second heat exchange tube satisfy a following condition:

$$0.2 < D1 * Tw2/Tw1 * D2 \leq 6.$$

4. The heat exchanger according to claim 1, wherein the ratio of the first hydraulic diameter to the second hydraulic diameter is greater than 1 and less than or equal to 4, and the ratio of the width of each first heat exchange tube to the width of each second heat exchange tube is greater than 1 and less than or equal to 3.

5. The heat exchanger according to claim 1, wherein along the length direction of the first tube, a minimum distance between two adjacent first heat exchange tubes is Tp1, a minimum distance between two adjacent second heat exchange tubes is Tp2, and Tp1 is not equal to Tp2, and the first hydraulic diameter of the first tube and the second hydraulic diameter of the second tube satisfy following conditions:

$$0.2 < D1 \times Tp2/Tp1 \times D2 \leq 30;\ 0.2 < Tp2/Tp1 \leq 5.$$

6. The heat exchanger according to claim 1, wherein a first distribution tube is disposed in a main channel of the first tube, the first distribution tube extends by a certain distance along the length direction of the first tube, the second tube includes a peripheral wall and a main channel surrounded by the peripheral wall of the second tube, a second distribution tube is disposed in the main channel of the second tube, the second distribution tube extends by a certain distance along a length direction of the second tube, a hydraulic diameter of the first distribution tube is D3, a hydraulic diameter of the second distribution tube is D4, and D3 and D4 satisfy a following condition: $1 \leq D3/D4 \leq 4$.

7. The heat exchanger according to claim 1, wherein a width of each fin is Fw, the width of each first heat exchange tube is Tw1, the width of each second heat exchange tube is Tw2, and Fw, Tw1 and Tw2 satisfy a following condition:

$$Tw2 < Fw \leq Tw1 + Tw2.$$

8. The heat exchanger according to claim 5, wherein a finless area section is defined between each fin and a peripheral wall of the first tube, a side of the heat exchanger positioned upstream in a wind direction during operation is defined as a windward side, a side of the heat exchanger positioned downstream in the wind direction is defined as a leeward side, and at least part of the second tube is positioned at the windward side or the leeward side of the finless area section.

9. The heat exchanger according to claim 1, wherein the second tube comprises a second channel and a fourth channel defined therein, and the fourth channel is communicated with the plurality of first heat exchange tubes, wherein the second channel is not communicated with the fourth channel, the first channel is communicated with the fourth channel, and the second channel is communicated with the third channel, wherein the part of the third tube is communicated with the plurality of first heat exchange tubes and the first channel, and the another part of the third tube is communicated with the plurality of second heat exchange tubes and the third channel, wherein part of the fourth tube is communicated with the plurality of second heat exchange tubes and the second channel, and another part of the fourth tube is communicated with the plurality of first heat exchange tubes and the fourth channel, and wherein a sum of a number of the plurality of first heat exchange tubes communicating with the first channel and a number of the plurality of first heat exchange tubes communicating with the fourth channel is a first numerical value, and a sum of a number of the plurality of second heat exchange tubes communicating with the second channel and a number of the plurality of second heat exchange tubes communicating with the third channel is a second numerical value, wherein the first numerical value and the second numerical value are not equal.

10. The heat exchanger according to claim 9, wherein the third tube comprises a fifth channel communicated with the first channel through the plurality of first heat exchange tubes, and further comprises a seventh channel communicated with the third channel through the plurality of second heat exchange tubes, and wherein the fourth tube includes a sixth channel communicated with the second channel through the plurality of second heat exchange tubes, and further comprises an eighth channel communicated with the fourth channel through the plurality of first heat exchange tubes.

11. A heat exchanger, comprising:

a first tube, a second tube, a third tube and a fourth tube;

a plurality of heat exchange tubes, wherein each of the plurality of heat exchange tubes is a microchannel flat tube, and the plurality of heat exchange tubes comprise a plurality of first heat exchange tubes and a plurality of second heat exchange tubes, wherein the plurality of first heat exchange tubes are not communicated with the plurality of second heat exchange tubes, wherein at least part of the plurality of first heat exchange tubes communicate the first tube with the third tube, wherein at least part of the plurality of second heat exchange tubes communicate the second tube with the fourth tube, wherein the first tube comprises a first channel defined therein, and the second tube comprises a second channel defined therein, wherein the first channel is communicated with the plurality of first heat exchange tubes, and the second channel is communicated with the plurality of second heat exchange tubes, wherein a maximum length of the first channel in a length direction of the first tube is not equal to a maximum length of the second channel in a length direction of the second tube, and wherein the plurality of first heat exchange tubes and the plurality of second heat exchange tubes are arranged at intervals along the length direction of the first tube, and each first heat exchange tube is arranged at a side of each of at least two of the plurality of second heat exchange tubes in the length direction of the first tube; and fins, wherein at least part of the fins is arranged between two adjacent heat exchange tubes in the length direction of the first tube, wherein the first tube comprises a third channel, the third channel is communicated with the plurality of second heat exchange tubes and is not communicated with the first channel, the first channel and the third channel are arranged along the length direction of the first tube, part of the third tube is communicated with the plurality of first heat exchange tubes and the first channel, another part of the third tube is communicated with the plurality of second heat exchange tubes and the third channel, and the first tube includes a baffle plate which separates the first channel and the third channel, and wherein the second tube, the plurality of second heat exchange tubes and the fourth tube form a first flow path; the first channel, a channel in the plurality of first heat exchange tubes and a channel in the part of the third tube form a second flow path; and the third channel, a channel in the plurality of second heat exchange tubes and a channel in the another part of the third tube form a third flow path.

12. The heat exchanger according to claim 11, wherein a length of the first tube is smaller than a length of the second tube, and a number of the plurality of first heat exchange tubes communicating with the first channel is smaller than a number of the plurality of second heat exchange tubes communicating with the second channel.

13. The heat exchanger according to claim 11, wherein the second tube is arranged adjacent to the first tube relative to the third tube, the fourth tube is arranged adjacent to the third tube relative the first tube, and a length of the third tube is smaller than a length of the fourth tube.

14. The heat exchanger according to claim 11, further comprising:

a fifth tube and a sixth tube, wherein the plurality of heat exchange tubes further comprise a plurality of third heat exchange tubes, wherein the plurality of third heat exchange tubes communicate the fifth tube with the sixth tube, the fifth tube and the first tube are not communicated with each other, a length of the fifth tube is smaller than a length of the second tube, a number of the plurality of third heat exchange tubes is smaller than a number of the plurality of second heat exchange tubes, and the plurality of second heat exchange tubes and the plurality of third heat exchange tubes are spaced apart from each other along the length direction of the second tube.

15. The heat exchanger according to claim 11, wherein the second tube comprises a fourth channel communicated with the plurality of first heat exchange tubes, wherein the second channel is not communicated with the fourth channel, the first channel is communicated with the fourth channel, and the second channel is communicated with the third channel, wherein the part of the third tube is communicated with the plurality of first heat exchange tubes and the first channel, and the another part of the third tube is communicated with the plurality of second heat exchange tubes and the third channel, wherein part of the fourth tube is communicated with the plurality of second heat exchange tubes and the second channel, and another part of the fourth tube is communicated with the plurality of first heat exchange tubes and the fourth channel, and wherein a sum of a number of the plurality of first heat exchange tubes communicating with the first channel and a number of the plurality of first heat exchange tubes communicating with the fourth channel is a first numerical value, and a sum of a number of the plurality of second heat exchange tubes communicating with the second channel and a number of the plurality of second heat exchange tubes communicating with the third channel is a second numerical value, wherein the first numerical value and the second numerical value are not equal.

16. The heat exchanger according to claim 15, wherein the third tube comprises a fifth channel communicated with the first channel through the plurality of first heat exchange tubes, and further comprises a seventh channel communicated with the third channel through the plurality of second heat exchange tubes; and wherein the fourth tube includes a sixth channel communicated with the second channel through the plurality of second heat exchange tubes, and further comprises an eighth channel communicated with the fourth channel through the plurality of first heat exchange tubes.

17. The heat exchanger according to claim 11, wherein the heat exchanger is configured in at least one of following manners:

a hydraulic diameter of the first tube is smaller than a hydraulic diameter of the second tube; and a hydraulic diameter of the third tube is smaller than a hydraulic diameter of the fourth tube.

18. The heat exchanger according to claim 17, wherein the heat exchanger is configured in at least one of following manners:

a width of each first heat exchange tube is greater than a width of each second heat exchange tube; and a length of each second heat exchange tube is greater than a length of each first heat exchange tube.

19. A multi-system air conditioning unit, comprising a heat exchanger, the heat exchanger comprising:

a first tube, a second tube, a third tube and a fourth tube;

a plurality of heat exchange tubes, wherein each of the plurality of heat exchange tubes is a microchannel flat tube, and the plurality of heat exchange tubes comprise a plurality of first heat exchange tubes and a plurality of second heat exchange tubes, wherein the plurality of first heat exchange tubes are not communicated with the plurality of second heat exchange tubes, wherein at least part of the plurality of first heat exchange tubes communicate the first tube with the third tube, wherein at least part of the plurality of second heat exchange tubes communicate the second tube with the fourth tube, wherein the first tube comprises a first channel defined therein, the second tube comprises a second channel defined therein, the first channel is communicated with the plurality of first heat exchange tubes, and the second channel is communicated with the plurality of second heat exchange tubes, wherein a maximum length of the first channel in a length direction of the first tube is not equal to a maximum length of the second channel in a length direction of the second tube, and wherein the plurality of first heat exchange tubes and the plurality of second heat exchange tubes are arranged at intervals along the length direction of the first tube, and each first heat exchange tube is arranged at a side of each of at least two of the plurality of second heat exchange tubes in the length direction of the first tube; and fins, wherein at least part of the fins is arranged between two adjacent heat exchange tubes in the length direction of the first tube, wherein the first tube comprises a third channel, the third channel is communicated with the plurality of second heat exchange tubes and is not communicated with the first channel, the first channel and the third channel are arranged along the length direction of the first tube, part of the third tube is communicated with the plurality of first heat exchange tubes and the first channel, another part of the third tube is communicated with the plurality of second heat exchange tubes and the third channel, and the first tube includes a baffle plate which separates the first channel and the third channel, wherein the second tube, the plurality of second heat exchange tubes and the fourth tube form a first flow path; the first channel, a channel in the plurality of first heat exchange tubes and a channel in the part of the third tube form a second flow path; and the third channel, a channel in the plurality of second heat exchange tubes and a channel in the another part of the third tube form a third flow path, and wherein the multi-system air conditioning unit comprises a plurality of refrigeration systems, and at least two of the plurality of refrigeration systems share the heat exchanger.

20. The multi-system air conditioning unit according to claim 19, wherein the multi-system air conditioning unit comprises a first system and a second system, wherein the first system comprises a first compressor set, and the first system is communicated with the first tube and the third tube of the heat exchanger, wherein the second system comprises a second compressor set, and the second system is communicated with the second tube and the fourth tube of the heat exchanger, and wherein a ratio of an output power of the first compressor set to an output power of the second compressor set is greater than 1.5 and less than or equal to 5.

* * * * *